US009434522B2

(12) United States Patent
Leiner et al.

(10) Patent No.: US 9,434,522 B2
(45) Date of Patent: Sep. 6, 2016

(54) PACKAGING FOR STORING A FREE-FLOWING, PASTE-LIKE OR POWDERY SUBSTANCE AND METHOD FOR STORING AND APPLYING THE SUBSTANCE

(75) Inventors: Uwe Leiner, Midlum (DE); Manfred T. Plaumann, Cuxhaven (DE)

(73) Assignee: VOCO GMBH, Cuxhaven (DE)

( * ) Notice: Subject to any disclaimer, the term of this patent is extended or adjusted under 35 U.S.C. 154(b) by 876 days.

(21) Appl. No.: 12/364,734

(22) Filed: Feb. 3, 2009

(65) Prior Publication Data

US 2009/0194451 A1 Aug. 6, 2009

(30) Foreign Application Priority Data

Feb. 4, 2008 (DE) ..... 10 2008 000 232

(51) Int. Cl.

*B65D 85/84* (2006.01)
*B65D 41/00* (2006.01)
*B65D 75/32* (2006.01)

(52) U.S. Cl.

CPC ..... *B65D 75/327* (2013.01); *B65D 75/328* (2013.01); *B65D 2575/3236* (2013.01); *B65D 2575/3245* (2013.01)

(58) Field of Classification Search

CPC ..... B65D 75/327; B65D 75/328; B65D 2575/3245; B65D 2575/3236

USPC ..... 206/63.5, 219, 221, 222, 484, 220, 368, 206/369, 370, 459.1, 461–471, 438–439, 206/229, 209, 528–540; 426/106

See application file for complete search history.

(56) References Cited

U.S. PATENT DOCUMENTS

| | | | | |
|---|---|---|---|---|
| 3,083,821 | A * | 4/1963 | Woodson | 206/568 |
| 3,088,587 | A * | 5/1963 | Dimmig et al. | 206/727 |
| 3,835,834 | A * | 9/1974 | Brown et al. | 600/572 |
| 3,913,562 | A * | 10/1975 | Moore et al. | 435/307.1 |
| 3,948,391 | A * | 4/1976 | Beaman | 206/382 |
| 4,498,589 | A | 2/1985 | Scott et al. | |
| 4,673,085 | A * | 6/1987 | Badouard et al. | 220/266 |
| 4,786,534 | A * | 11/1988 | Aiken | 428/34.2 |
| 4,844,251 | A * | 7/1989 | Gueret | 206/222 |
| 5,375,701 | A * | 12/1994 | Hustad et al. | 206/542 |
| 6,056,141 | A * | 5/2000 | Navarini et al. | 220/269 |
| 6,105,761 | A * | 8/2000 | Peuker et al. | 206/229 |

FOREIGN PATENT DOCUMENTS

| | | |
|---|---|---|
| DE | 2327206 A | 12/1974 |
| DE | 8105156 U1 | 7/1981 |

* cited by examiner

*Primary Examiner* — Chun Cheung

(74) *Attorney, Agent, or Firm* — J. Rodman Steele, Jr.; Gregory M. Lefkowitz; Duane Morris LLP

(57) ABSTRACT

A packaging (100, 200) for storing a free-flowing, paste-like or powdery substance (110), includes a bottom foil (120, 220) and a covering foil (130, 230) which are sealed to each other at least in certain portions, and a removal chamber (140, 240) which is formed from regions of the bottom foil and the covering foil that are detachably sealed to one another at least in certain portions, wherein the removal chamber can be opened by detaching at least a first portion (131, 231) of the covering foil from the bottom foil, wherein a second portion (132, 232), which is arranged adjacent to the first portion, of the covering foil displays less deformation resistance than the first portion of the covering foil, so that plastic deformation, required for opening the removal chamber, of the covering foil occurs substantially in the second portion of the covering foil.

40 Claims, 6 Drawing Sheets

PACKAGING FOR STORING A FREE-FLOWING, PASTE-LIKE OR POWDERY SUBSTANCE AND METHOD FOR STORING AND APPLYING THE SUBSTANCE

FIELD OF THE INVENTION

The invention relates to a packaging for storing a free-flowing, paste-like or powdery substance (in particular a dental substance), consisting of or comprising a bottom foil and a covering foil which are sealed to each other at least in certain portions, and a removal chamber which is formed from regions of the bottom foil and the covering foil that are detachably sealed to one another at least in certain portions, wherein the removal chamber can be opened by detaching at least a first portion of the covering foil from the bottom foil.

Furthermore, the invention relates to a collecting device for storing at least one free-flowing, paste-like or powdery substance and also to a method for storing and applying a free-flowing, paste-like or powdery substance.

BACKGROUND OF THE INVENTION

Packagings of the type mentioned at the outset are used frequently in dental technology to provide substances, for example for the treatment of patients.

DE 81 05 156 U1 describes a covering foil web from which covers to be applied to packaging cavities formed from a plastics material film web are to be punched out. The covering foil web is provided on its upper side and/or underside with self-adhesive labels associated with the individual covers.

DE 23 27 206 A discloses a single-dose packaging, preferably for administering medicaments, consisting of a lower foil containing a chamber and a closure foil covering the chamber and also of a permanently adhesive marking foil which is releasably fastened to the packaging. The marking foil is embodied as a closure foil, provided with a gripping surface and configured so as to be detachable from the packaging while at the same time opening the chamber.

U.S. Pat. No. 5,375,701 A describes a food package having a compartmentalised rigid base tray which holds the food products and a flexible foil hermetically sealing the compartments. In combination therewith, labelling means are provided which eliminate the need for an outer enclosure container, while still providing sufficient space to convey label information.

WO 00/09416 discloses a packaging for two-component products and a method for the manufacture thereof. Disclosed therein is a packaging for an epoxy resin and a hardener, containing a thermoformed element having two chambers for in each case epoxy resin and hardener. A foil is laminated onto the underside of the thermoformed element in order to close each chamber. A lamination between the chambers at the interface of the thermoformed element and laminated-on foil tears open when pressure is applied from the outside onto one of the chambers. The tearing-open connects the two chambers and allows epoxy resin and hardener to be blended in a closed envelope. The mixed adhesive can be removed through a removal opening formed by a channel which is to be broken open and is connected to one of the chambers.

DE 31 22 237 A1 discloses a packaging for liquid fillers, consisting of a deep-drawn part and a covering foil upwardly tightly closing off the deep-drawn part. Located in the gap formed between the deep-drawn part and covering foil are the liquid fillers and also an insertion part (swab, sponge, dripper, stopper, etc.) for dispensing liquid. The packaging has a predetermined breaking point which is positioned in such a way that when one part of the packaging breaks off from the remaining part, the insertion part is exposed, so that liquid is dispensed through a through-channel from the liquid space through the insertion part.

Drawbacks of the solutions shown in WO 00/09416 and DE 31 22 237 A1 include the fact that all of the packaging must be handled for removing and applying the contents. This is disadvantageous in particular in dental applications which are difficult to reach. Furthermore, the speed at which the contents are removed from the proposed packagings is difficult to control and the amount that is removed is difficult to meter.

DE 298 14 215 U1, WO 96/03326, DE 100 47 679 A1 and EP 0 895 943 B1 disclose packagings with applicators. DE 298 14 215 U1 shows a multiple-chamber packaging made up of a thermoplastic deep-drawn part with at least two bowls and a sealed-on covering foil. The packaging is equipped with a bowl containing a liquid medium. An absorbent insert is located in a second bowl. The bowls are separated from one another by a region of the web that is sealed to the covering foil in a peelable manner. By applying pressure to the first bowl, the peeling seal between the covering foil and web opens between the bowls and the impregnating medium from the first bowl runs into the second bowl and wets the insert. By pulling up a free peeling tab, the covering foil, which is sealed to the deep-drawn part on the edge side in a peelable manner, can be pulled up and the impregnated insert removed. As the application part to be impregnated, a rod having an absorbent head can also be inserted into the bowl.

WO 96/03326 discloses a tray with wells for receiving a medicament and an applicator. The applicator well has an open end beyond which a substantial portion of the applicator protrudes. A cover made of a thin, flexible sheet material seals the entire surface of the tray. The protruding portion of the applicator can be used to break open the cover. Once the cover has been removed, the medicament can be applied in a simple and practical manner, wherein the entire packaging and the applicator can easily be disposed of after use.

DE 100 47 679 A1 discloses a device for the storing and mixing in particular of paste-like masses. The device comprises at least one chamber which can receive a substance, wherein the at least one chamber is formed by the peelable sealing of a base foil and a covering foil. On activation of the device by pulling-apart or detaching of the covering foil from the base foil, there is in this way carried out on the base foil, as a function of the selected arrangement of the substance to be mixed, a division, on the exposed, substantially planar mixing region, into two separately mixable portions.

The solutions disclosed in DE 298 14 215 U1, WO 96/03326 and DE 100 47 679 A1 have the drawback that the foil to be detached enters into contact in the storage state with a for example free-flowing or paste-like substance and there can adhere to the detached foil substance residues which can lead, during handling of the foil or the packaging, to bonding to or soiling of the environment of the packaging, equipment or users. Breaking-open or tearing of the foil intensifies this drawback and can furthermore lead to the foil having to be removed in an awkward manner in a plurality of, often small, individual parts.

EP 0 895 943 B1 discloses a device for storing and dispensing a free-flowing substance with a container made of two foils. The separation between the chambers has a passage region which can be opened selectively by externally applied pressure and a chamber is embodied as a pocket which is outwardly open already in the storage condition. The substance is removed preferably by an application instrument which is mounted in the pocket or is to be introduced into the pocket by the user and can be wetted or brought into contact with the substance without the container as a whole being opened.

Drawbacks of this solution include the fact that the application instrument must be reintroduced into the narrow pocket when the application instrument is to be brought back into contact with the substance. This is awkward for a user and can lead to substance adhering in the channel and to the mouth thereof, and thus no longer being available for application and being able to soil both the packaging and the environment thereof.

The Applicant's own EP 1 153 579 B1 discloses a device for storing and applying one-component or multiple-component free-flowing dental materials. A well for receiving a substance is closed by a foil. The foil can be pierced using a suitable application apparatus in order subsequently to remove the substance from the well.

A packaging for storing at least two substances in separate containers is additionally known from the Applicant's own DE 102 43 401 A1, wherein the chambers are formed from portions, which are sealed to one another in a liquid-tight manner, of a bottom foil and a covering foil and in a region connecting the chambers, the bottom foil and the covering foil are sealed to each other in such a way that by exerting a pressure from the outside onto the first chamber, the sealing connection between the foils can selectively become detached in said region, a through-channel can form between the first and the second chamber, and the first substance can be transferred from the first to the second chamber. The covering foil in a region which is associated with the second chamber and has a material weakening is pierced and the substances, which are blended before or after the piercing, are removed. An application apparatus having an application tip can be used for piercing the covering foil and advantageously also for blending and removing the substances.

While the solutions disclosed in EP 1 153 579 B1 and DE 102 43 401 A1 are suitable and advantageous for application in the dental field, it can however in individual cases be advantageous to allow the removal of substances without piercing a foil, for example if use is made of an application apparatus which is not suitable for piercing a foil.

SUMMARY OF THE INVENTION

The primary object of the invention is to specify a packaging, the handling of which is simplified or improved. A further object of the invention is to specify a packaging which simplifies or improves the removal or the application of at least one substance contained in the packaging. A further object of the invention is to specify a packaging which simplifies or improves the metering of at least one substance contained in the packaging.

The object is achieved by a packaging for storing a free-flowing, paste-like or powdery substance, consisting of or comprising a bottom foil and a covering foil which are sealed to each other at least in certain portions, and a removal chamber which is formed from regions of the bottom foil and the covering foil that are detachably sealed to one another at least in certain portions, wherein the removal chamber can be opened by detaching at least a first portion of the covering foil from the bottom foil, wherein a second portion, which is arranged adjacent to the first portion, of the covering foil displays less deformation resistance than the first portion of the covering foil, so that deformation, required for permanently opening the removal chamber, of the covering foil occurs substantially in the second portion of the covering foil.

A core idea underlying the invention is to use a covering foil having differing deformation resistance in certain portions in order in this way to be able to influence deformation of the covering foil that occurs during attachment of at least one part of the covering foil. The second portion provided in accordance with the invention of the covering foil of the packaging according to the invention serves in this case as a desired deformation portion. Compared to the first portion of the covering foil, it is less stable with respect to deformation, in particular plastic deformation. That is to say, whereas during detachment of the first portion of the covering foil from the bottom foil, the first, comparatively stable portion maintains a substantially planar shape or resumes such a shape after elastic deformation, the second portion of the covering foil undergoes deformation, preferably plastic deformation, substantially along a narrow, roughly linear region, so that the first portion of the covering foil can be detached from the bottom foil. The opening of the removal chamber has in this case previously been understood and will continue to be understood as permanent opening.

The deformation resistance of the second portion, which is lower than the deformation resistance of the first portion, of the covering foil can be realised via weakening of the covering foil in the region of the second portion or strengthening in the region of the first portion of the covering foil.

The configuration of the packaging according to the invention has the advantage that any or at least a marked rolling-up or uncontrolled buckling of the first portion of the covering foil can be substantially avoided during opening of the packaging. The first portion of the covering foil remains during detachment and preferably also thereafter, in the opened state of the packaging, more dimensionally stable than known covering foils, preferably even substantially dimensionally stable. That has the advantage that soiling of the user of the packaging according to the invention, of the environment or of apparatuses can be avoided or reduced, because substance adhering to the first portion of the covering foil is distributed less markedly by uncontrolled rolling-up, buckling or bending.

A further advantage of the packaging according to the invention is the fact that the packaging can be disposed of after use in one operation as a one-part piece if the covering foil—as is frequently provided—is not completely detached from the bottom foil.

The substance to be stored can be any desired substance, but preferably a dental material. The substance can in this case be embodied as a one-component or multiple-component substance, have various consistencies such as for example powdery, paste-like, free-flowing or liquid and contain homogeneously or heterogeneously dissolved, solid or gaseous constituents. In particular, the substance can be a fluoride varnish.

In the case of a preferred packaging according to the invention, the deformation occurring in the second portion of the covering foil during opening of the removal chamber is substantially plastic deformation.

An action of force required for opening the removal chamber causes in this case in the second portion of the covering foil plastic deformation which is maintained after the action of force, i.e. after the opening of the removal chamber. Recoiling of the first portion of the covering foil as a result of resilient reforming of the deformation in the second portion of the covering foil is as a result substantially prevented. This has the advantage that a substance adhering to the first portion of the covering foil does not enter into contact with the user, apparatuses or the environment, in particular during handling packaging for example during application of the substance. Thus, disadvantageous soiling or bonding can be avoided.

In the case of a preferred packaging according to the invention, the deformation occurring in the second portion of the covering foil during opening of the removal chamber displays a higher proportion of plastic deformation than the deformation occurring in the first portion of the covering foil during opening of the removal chamber. Particularly preferred is in this case a packaging according to the invention for storing a free-flowing, paste-like or powdery substance, consisting of or comprising a bottom foil (120, 220) and a covering foil (130, 230) which are sealed to each other at least in certain portions, and a removal chamber (140, 240) which is formed from regions of the bottom foil and the covering foil that are detachably sealed to one another at least in certain portions, wherein the removal chamber can be opened by detaching at least a first portion (131, 231) of the covering foil from the bottom foil, wherein a second portion, which is arranged adjacent to the first portion, of the covering foil displays less deformation resistance than the first portion of the covering foil, so that deformation, required for permanently opening the removal chamber, of the covering foil occurs substantially in the second portion of the covering foil, characterised in that the deformation occurring in the second portion of the covering foil during opening of the removal chamber (140, 240) displays a higher proportion of plastic deformation than the deformation occurring in the first portion of the covering foil during opening of the removal chamber.

These preferred packagings according to the invention have the advantage that deformation, occurring during opening of the removal chamber, of the first portion of the covering foil is resiliently reformed to a greater extent than the deformation, occurring during opening of the removal chamber, of the second portion of the covering foil, which deformation has a comparatively higher plastic proportion, preferably is even substantially plastic. As a result, the stability of the covering foil in the opened state can be improved, as the plastic deformation in the second portion of the covering foil (co)determines the position of the first portion of the covering foil and the first portion of the covering foil displays, as a result of the resilient reforming of at least one part of its deformation in the opened state, overall lower deformation. These advantages according to the invention are also achieved if a certain, comparatively preferably small, proportion of plastic deformation is maintained in the first portion of the covering foil.

Preferably, the second portion of the covering foil is arranged between the first portion of the covering foil and a third portion of the covering foil and the second portion of the covering foil displays lower deformation resistance than the third portion of the covering foil.

A configuration in which the second portion of the covering foil is arranged between the first portion and the third portion of the covering foil is for example preferred if the second portion, as the desired deformation portion, is intended to display only limited extension and/or a third portion of the covering foil having higher deformation resistance is preferred, for example, for production and/or application-specific reasons.

It will be understood that preferred configurations of the packaging according to the invention, which relate to different features, are preferably present at the same time, for example a plastically deformable second portion wherein said second portion lies between a first and a third portion.

The first portion of the covering foil and the second portion of the covering foil of a packaging according to the invention have preferably a substantially identical width and the length of the second portion of the covering foil is less than the length of the first portion of the covering foil. In addition, it is preferred for the first portion of the covering foil and the third portion of the covering foil to have a substantially identical width and the length of the first portion of the covering foil to be less than the length of the third portion of the covering foil.

A substantially identical width of the covering foil portions has inter alia advantages in terms of manufacture, as in this way use can be made for example of a continuous covering foil which is weakened in the second portion or is strengthened in the first portion and/or in the third portion. The second portion undergoes deformation preferably substantially in a narrow region; a length of the second portion that is correspondingly less than the first portion is therefore advantageous.

As the first portion of the covering foil covers or in accordance with the invention after the detachment frees the removal chamber, a greater length of the first portion is advantageous in order to attain a correspondingly large opening of the removal chamber and to simplify handling of the packaging and the application of the substance.

The third portion of the covering foil can have various dimensions. In a preferred configuration, it is longer than both the first and the second portion of the covering foil.

Alternatively or—preferably—in addition to the previously described features of preferred packagings according to the invention concerning the embodiment of various portions of the covering foil, in particular the embodiment of various portions of the covering foil having different deformation resistances, preferred packagings according to the invention comprise preferably also the features described hereinafter with regard to the embodiment of the covering and/or bottom foil. Preferably, preferred configurations of the packaging according to the invention, which relate to different features, are present at the same time.

In preferred packagings according to the invention, the covering foil comprises a blocking foil, preferably a blocking foil made of metallic material, for example an aluminum foil having a thickness of approximately 20 μm, or consists of a blocking layer of this type.

A blocking foil of this type is in particular preferred if there are to be stored in the packaging one or more substances containing materials which for example can diffuse through plastics material. A blocking foil is preferably embodied in such a way that it prevents diffusion, in particular of gaseous substance constituents, through the covering foil. A preferred blocking foil is embodied in such a way that it protects the substance or substances for example from light.

As a result, the storage life of the substances is improved and/or lengthened.

In preferred packagings according to the invention, the covering foil has in the first and/or in the third portion a reinforcement layer, preferably made of plastics material or paper.

In addition or alternatively to weakening of the second portion of the covering foil, the first portion and/or the third portion of the covering foil are thus strengthened. Strengthening of this type is applied to the covering layer preferably as a reinforcement layer. For example, the covering foil can be embodied as a composite foil having at least two composite layers, wherein one of these composite layers is the reinforcement layer. This reinforcement layer can be made of any desired materials or material combinations; preferred materials are plastics material or paper.

In this case, it is particularly preferred that the reinforcement layer of the first and/or of the third portion of the covering foil be embodied as an imprinted or non-imprinted adhesive label.

Preferably, adhesive labels are used as the reinforcement layer of the covering foil in the first portion and/or in the third portion of the covering foil. Conventional adhesive labels can be used for this purpose, and this has a positive effect on the manufacturing costs. Furthermore, it is advantageous to provide the labels with an overprint, for example with information about the substance contained and the application thereof, so that further marking may be dispensed with. Adhesive labels additionally have the advantage that no additional adhesive has to be applied to the covering foil in order to fasten the reinforcement layer; this can also positively affect the manufacturing costs. The adhesive labels are in this case selected preferably in accordance with the requirements for stability and deformation resistance, imprintability and adhesive properties of the adhesive labels and covering foil, in each case in interaction with the further materials of the covering foil.

The packaging according to the invention can furthermore be configured in that the covering foil is provided on its side remote from the bottom foil with an anticorrosive, preferably a stoving enamel, and/or on its side facing the bottom foil with a sealing layer, wherein the sealing layer is preferably a peelable heat sealing lacquer having a thickness of from approximately 2 to 8 μm or polyolefin having a thickness of less than 25 μm.

Packagings according to the invention frequently serve also to lengthen storage of a substance and are often at the same time a commercial form. High wear resistance of the packaging is therefore a preferred property of a packaging according to the invention. The provision of an anticorrosive has to this extent the advantage that for example a covering foil made of metallic material is protected from wear by corrosion.

In packagings according to the invention, the covering and bottom foil are furthermore sealed to each other at least in certain portions. In order to allow this sealing, it is advantageous (first) to arrange a sealing layer on the side of the covering foil with which it is to be sealed to the bottom foil. Preferably, the sealing layer is a polyolefin, for example polyethylene, polypropylene, polybutylene, polystyrene, polycarbonate, a similarly constructed hydrocarbon polymer or a copolymer of various polyolefins, having a thickness of less than 25 μm. The use of polyolefin having a thickness of more than 25 μm or of other plastics materials, such as for example PVC, is also possible.

The choice of the sealing layer material and the sealing layer thickness is adapted preferably to the configuration of the blocking foil of the covering foil and to the configuration of the bottom foil. The seal is produced preferably by welding or bonding the sealing layer of the covering foil to the bottom foil, preferably to a sealing layer of the bottom foil.

According to a further configuration of the packaging according to the invention, the first and/or the third portion of the covering foil have in each case a central region and an edge region, wherein the deformation resistance of the respective edge region is less than the deformation resistance of the respective central region.

A configuration of this type has for example advantages in manufacture, if the deformation resistance of the first and/or third portion of the covering foil is strengthened by strengthening, such as for example by applying an adhesive label, and in this case there is provided with the strengthening not the respective entire portion of the covering foil, but rather only the respective central region of the first or third portion of the covering foil.

It is in some cases preferred for the edge region of the first and/or third portion of the covering foil not to be sealed to the bottom foil at least in certain portions. This has the advantage that a user cannot grip the edge region or a portion of the edge region to detach the covering foil or a portion thereof from the bottom foil.

In addition, it is preferred for the covering foil to have one, two or more detachment aids, preferably one, two or more peeling tabs.

A detachment aid or peeling tab of this type can facilitate for a user secure gripping of the covering foil for applying a force required for detaching the covering foil. Preferably, the detachment aid or peeling tab is arranged on the portion of the covering foil that is to be detached from the bottom foil for opening the removal chamber. One of the above-described edge regions, in particular of the first portion of the covering foil, can advantageously also serve as the detachment aid or peeling tab.

According to a further configuration of the invention, the bottom foil is embodied as a composite foil, wherein the composite foil preferably comprises:

- a sealing layer facing the covering layer, for example polyolefin having a thickness of approximately 60 μm,
- a blocking foil, for example aluminum foil having a thickness of approximately 45 μm,
- an outer foil which is remote from the covering foil, for example oriented polyamide having a thickness of approximately 25 μm,
- wherein an adhesion promoter, for example a laminating adhesive, is arranged preferably between the sealing layer and blocking foil and/or the blocking foil and outer foil, and
- wherein the sealing layer, the blocking foil and the outer foil are arranged preferably in the specified order.

As previously illustrated for the covering foil, it is also advantageous, in the case of the bottom foil, to provide thereon a sealing layer on the side to be sealed to the covering foil. Preferably, the sealing layer is a polyolefin, for example polyethylene, polypropylene, polybutylene, polystyrene, polycarbonate, a similarly constructed hydrocarbon polymer or a copolymer of various polyolefins, having a thickness of approximately 60 μm. The choice of the sealing layer material and the sealing layer thickness is adapted preferably to the configuration of the blocking foil of the bottom foil and to the configuration of the covering foil, in particular the sealing layer thereof. The seal is produced preferably by welding or bonding the sealing layer of the bottom foil to the covering foil, preferably to the sealing layer of the covering foil.

A blocking foil is advantageous in order, as illustrated hereinbefore, to improve or to lengthen the storage life of the substance. The outer foil affords the advantage of imparting overall stability to the packaging. An adhesion promoter, which is optionally arranged between the layers, can assist a composite action of the layers. The adhesion promoter is preferably solvent-resistant, in particular if the substance to be stored necessitates this.

In a preferred configuration, the bottom foil is embodied as a coextruded foil, in particular as a coextruded multilayer foil. In this case, a polyolefin layer can for example be applied in liquid form in a hot state and the adhesion promoter can be added to the compound to be applied.

The bottom foil of a packaging according to the invention is embodied preferably as a deep-drawn foil.

A configuration of this type is advantageous in terms of manufacture and with regard to the costs of the packaging.

The removal chamber of a packaging according to the invention is embodied preferably as a well in the bottom foil that is covered by the covering foil.

Preferably, one or more further chambers are also embodied as wells in the bottom foil that are covered by the covering foil.

Chambers of the packaging are formed preferably by depressions or bowls in the bottom foil. The chambers can be filled in accordance with the requirement and function and are subsequently covered by the covering foil. By sealing the covering foil and bottom foil to each other in the regions surrounding the chambers, the chambers are closed before they are reopened and made accessible for use by detaching the covering foil or at least a portion of the covering foil.

A further preferred packaging according to the invention has one, two or more stabilisation beads embodied in the bottom foil.

The stabilisation beads can be embodied as further, non-filled wells in the bottom foil. They then serve primarily overall to increase the stability of the packaging. Furthermore, it is preferred for the stabilisation beads to have substantially the same height as the removal chamber and if appropriate further wells in the bottom foil, so that the packaging can be set down on a substantially planar surface, in particular without any substance being able in this case to issue from or run out of the packaging in an undesired manner.

Preferred features of the packaging according to the invention will be described hereinafter with regard to the embodiment of the seal. This preferred configuration of the packaging according to the invention is preferably present at the same time as further preferred configurations of the packaging according to the invention.

In preferred packagings according to the invention, the covering foil and the bottom foil are sealed to each other by a seal.

The seal is produced in this case preferably via the sealing layer of the covering foil and/or the sealing layer of the bottom foil.

The seal is in this case embodied so as to be peelable preferably at least between the first portion of the covering foil and the bottom foil, so that the first portion of the covering foil is detachable from the bottom foil.

If the covering foil and the bottom foil are joined together via a peelable seal, they can be separated from each other by "peeling" (English for "detaching"). This is an advantageous and preferred manner to open chambers of the packaging, in particular the removal chamber, without having for this purpose to pierce the covering foil or bottom foil and without having to provide an opening with a corresponding closure in one of the foils.

The seal is in this case embodied in its entirety so as to be peelable preferably between the covering foil and bottom foil, so that the covering foil can be completely detached from the bottom foil.

This configuration is advantageous for example when the removal chamber or a plurality of removal chambers extend over a large portion of the length of the packaging and the entire removal chamber or all removal chambers are to be opened immediately or gradually. The configuration can also be advantageous if for example there is to be mounted in the packaging an applicator which can be removed in a user-friendly manner only by complete detachment of the covering foil from the bottom foil.

In individual cases, it is advantageous to configure the seal between the covering foil and bottom foil in such a way that it displays differing sealing strengths in certain portions.

The seal between the covering foil and bottom foil can display various properties as a function, for example, of the thickness and material of the sealing layer(s), the manner in which the seal is produced (for example welding, adhesive bonding) or the geometry of the seal. These properties include the sealing strength. The sealing properties and the measures for production thereof are known to a person skilled in the art in this field. Within the scope of the present invention, it is frequently preferred for the strength of the seal to vary in certain portions.

It is preferred for the seal to have between the covering foil and bottom foil regions having different seal geometries, preferably regions having a planar seal and/or regions having a linear seal.

This embodiment of the seal can for example serve, as described above, to influence the sealing strength or to allow the formation of various chambers.

The seal between the second portion and/or the third portion of the covering foil and the bottom foil displays preferably a higher strength than the seal between the first portion of the covering foil and the bottom foil.

It is in particular preferred if the sealing strength between the first portion of the covering foil and the bottom foil is lower than the sealing strength between the second and/or third portion of the covering foil and the bottom foil. This is for example advantageous if the first portion of the covering foil is intended to be easily detachable compared to the second and/or third portion of the covering foil.

The seal between the covering foil and bottom foil is preferably embodied so as to be peelable in certain portions and not to be peelable in certain portions.

This configuration is advantageous if only a specific portion of the covering foil is intended to be detachable from the bottom foil and another portion is intended to remain closed permanently, i.e. both in the storage state and in the opened use or removal state. In the present invention, it is in particular preferred for (only) the first portion of the covering foil, in some cases also the second portion of the covering foil, to be detachable.

The deformation resistance of the first portion of the covering foil is preferably greater at least in certain portions than the sealing strength of the seal between the first portion of the covering foil and the bottom foil.

As a result of this configuration, it can be attained that, at least in certain portions, an action of force applied by a user to detach the covering foil leads to the sealing strength of the seal between the first portion of the covering foil and the bottom foil being overcome and the first portion of the covering foil being detached from the bottom foil, while the first portion of the covering foil substantially maintains its shape.

In other configurations, the deformation resistance of the first portion of the covering foil can also be equal to or less than the sealing strength of the seal between the first portion of the covering foil and the bottom foil. In this case, deformation of the first portion of the covering foil can occur during opening of the packaging. However, in the opened state, the deformation, in particular the plastic deformation, of the first portion of the covering foil is lower compared to the deformation, in particular the plastic deformation, of the second portion of the covering foil.

The deformation resistance of the second portion of the covering foil of a preferred packaging according to the invention is lower, preferably at least in certain portions, than the sealing strength of the seal between the second portion of the covering foil and the bottom foil.

According to this configuration of the invention, at least a part of the second portion of the covering foil is sealed to the bottom foil. A specific action of force applied by a user to detach the covering foil then leads to the second portion of the covering foil undergoing deformation, but not becoming detached from the bottom foil.

Furthermore, it is preferred for the seal between the covering foil and bottom foil to be produced by means of welding or adhesive bonding.

Methods for producing a seal between the covering foil and bottom foil are known to a person skilled in the art. It is also known to produce a seal having specific properties, such as for example a specific sealing strength. However, it is a surprising finding of the present invention that as a result of the combinations described in this application of specific sealing properties with specific combinations of material properties of the covering foil and the arrangement of the packaging constituents, the advantages described hereinbefore and hereinafter can be attained.

In a preferred packaging according to the invention, the seal between the covering foil and bottom foil is embodied so as to be fluid-tight at least in certain portions.

As mentioned hereinbefore, it can be advantageous, depending on the substance to be stored, to prevent the substance or substance constituents from issuing from the closed packaging, for example by diffusion. In order to ensure this, it is advantageous to seal the covering foil and the bottom foil to each other so as to be fluid-tight at least in certain portions, in order to prevent or to reduce diffusion of the substance or of substance constituents through the seal.

In some cases, it is advantageous in a packaging according to the invention for a portion of the covering foil to be able to be separated from the packaging. Features, which are preferred in this regard, of a packaging according to the invention will be described hereinafter. This preferred configuration of the packaging according to the invention is also present—as in general—preferably at the same time as further preferred configurations of the packaging according to the invention.

The first portion of the covering foil and the third portion of the covering foil of a packaging according to the invention can be separated from each other, preferably after the opening of the removal chamber, by generating a tear in the second portion of the covering foil.

During handling of the packaging, it can be advantageous to remove the first portion of the covering foil from the packaging. For this purpose, the first portion of the covering foil can be torn off in that a user generates a tear in the second portion of the covering foil. As soon as this tear extends over the entire width of the second portion, the first and third portions are separated from each other. Preferably, the first portion of the covering foil is separated off along a predetermined breaking point formed in the second portion of the covering foil, for example in the form of a notch or a tear.

The second portion of the covering foil then has preferably a tear aid or perforation which facilitates the generating of the tear in the second portion, wherein the tear aid or perforation is embodied preferably over the entire width, only over a portion of the width or only in an edge region of the second portion.

A tear aid or perforation can be configured for example as a predetermined breaking point, for example in the form of an incision, a notch or a series of apertures in the covering foil in the second portion. A tear aid or perforation of this type is advantageous to facilitate and/or to be able to control the formation of tears. The configuration of the tear aid or perforation is in this case adapted preferably to the material properties of the covering foil, in particular of the second portion of the covering foil.

Preferably, edge portions of the second portion of the covering foil, on which the tear aid or perforation is located or at which the tear aid or perforation begins, are not sealed to the bottom foil. This has the advantage that a user can securely grasp the edge portion of the second portion of the covering foil using the tear aid or perforation and apply a tear-generating force to the second portion of the covering foil.

Preferably, a boundary between the third portion of the covering foil and the second portion of the covering foil is embodied as a reference tear line in such a way that the tear in the second portion of the covering foil is formed substantially parallel to the boundary between the third portion of the covering foil and the second portion of the covering foil.

This is in particular advantageous to prevent the tear from forming not, as desired, in the second portion of the covering foil, but rather in an undesirable manner at least partly in the first and/or in the third portion of the covering foil. In this case, the reinforcement layer of the first or third portion of the covering foil can in particular have a supportive effect in that it prevents the formation of a tear in the first or third portion or impedes such formation in contrast to the formation of a tear in the second portion of the covering foil.

The features described hereinafter relate to a packaging according to the invention containing an applicator. This preferred configuration of the packaging according to the invention is also present preferably at the same time as further preferred configurations of the packaging according to the invention.

A further preferred configuration of a packaging according to the invention comprises an applicator chamber which is separated from the removal chamber and in which an applicator for applying the substance is releasably mounted, wherein the applicator chamber is formed from regions of the bottom foil and the covering foil that are detachably sealed to one another at least in certain portions.

It is often the case in packagings according to the invention and substances stored therein that an applicator is required for applying the substance. In this case, it can be advantageous to jointly provide the applicator in the packaging, in particular if it is a sanitary applicator for single use. Preferably, an applicator of this type is then mounted in a separate applicator chamber of the packaging in such a way that it can be removed from the applicator chamber for applying the substance.

The applicator can for example be embodied as a swab, dabber, spatula, brush or spoon.

The applicator chamber is preferably arranged in such a way that by detaching the first portion of the covering foil, the applicator chamber can be opened sufficiently wide to allow the applicator to be removed.

In this case, it is particularly preferred that by detaching the first portion of the covering foil, both the removal chamber and the applicator chamber are opened, so that a further measure for opening the respective other chamber may advantageously be dispensed with.

Advantageously, the applicator chamber has a widened region to facilitate removal of the applicator, wherein the applicator chamber is preferably arranged in such a way that by detaching the first portion of the covering foil, the widened region of the applicator chamber is accessible at least in certain portions, to allow the applicator to be removed in as user-friendly a manner as possible.

The applicator chamber has preferably a device for releasably arresting the applicator in the applicator chamber.

A device of this type can for example be a constriction of the applicator chamber in certain regions, with which constriction an applicator portion having an accordingly size-reduced cross section engages. Alternatively, the applicator chamber can for example also provide a widened region with which an applicator portion having an accordingly widened cross section engages.

The applicator has preferably a predetermined bending point at which the shape of the applicator can be adapted to the application environment, for example an oral cavity.

Further features of preferred packagings according to the invention will be described hereinafter. Preferably, preferred configurations of the packaging according to the invention, which relate to different features, are present at the same time.

The substance contained in a packaging according to the invention can consist of one or more components.

The term "a component" refers in this case to a constituent of the substance, without specifying the homogeneity of the substance, i.e. the substance can be embodied as a one-component or multiple-component substance, have various consistencies such as for example powdery, paste-like, free-flowing or liquid and contain homogeneously or heterogeneously dissolved, solid or gaseous constituents.

In preferred individual cases, the substance comprises one, two or more fluorides. In a preferred configuration, sodium fluoride is used in isolation or mixed with other fluorides.

The removal chamber of a packaging according to the invention has in many cases a volume of from (approx.) 0.05 ml to 2 ml. Particularly preferred are packagings having volumes of (approx.) 0.4 ml for application in adults and (approx.) 0.25 ml for application in children.

The packaging according to the invention is equipped conventionally as a, preferably sanitary, disposable packaging.

In particular in dental technology, there is frequently a need for substances which may be used only for a single patient and are to be provided preferably in sanitary form for this application, just as there is for the application tool required for the application of these substances. For this reason, the provision of the packaging according to the invention as a disposable packaging which is preferably in sanitary form is advantageous, as once the substance has entered into contact with a patient—albeit only indirectly via an application tool—it is not to be used for a second patient. The amount of the substance stored in the packaging corresponds in this case advantageously to the amount required for the treatment of a patient.

The removal chamber of a packaging according to the invention has preferably one, two or more markings for metering the substance to be removed from the removal chamber.

This can enable the user to apply only a portion of the substance—and in a precisely metered amount. This is advantageous for example in the treatment of children for whom only a portion of the amount of substance required for adults is to be applied. In manufacture, this configuration has the advantage that no different chamber or packaging sizes have to be realised, but rather a corresponding removal marking allows various amounts to be removed to be provided in the same packaging having the same substance amount. Advantageously, corresponding information about appropriate metering for the user is attached directly to or on the packaging, for example on the imprinted adhesive label of the first and/or third portion of the covering foil.

Preferably, the markings are in this case embodied on the bottom foil. Furthermore, the markings are embodied preferably on the blocking foil or on a side of the sealing layer. In a preferred configuration of the invention, the markings are applied by overprinting, embossing or laser inscription. In this case, the markings are embodied preferably in the form of lines, colour surfaces, specified text and/or specified figures. Furthermore, the markings are applied or overprinted in a precisely targeted manner, preferably by dispersed printing.

These configurations have the advantage of producing the markings as beneficially as possible in terms of manufacture and at the same time of ensuring good recognisability for the user.

The features described hereinafter relate to a preferred variant of a packaging according to the invention. Preferably, this preferred variant is present with individual, or a plurality of the, further preferred configurations of a packaging according to the invention.

Advantageous in many cases is a configuration in which the substance is stored in the removal chamber and the removal chamber is arranged in such a way that by detaching the first portion of the covering foil, the removal chamber can be opened at least sufficiently wide to allow the substance to be removed.

In this configuration of the invention, the substance is located in the removal chamber both in the storage state and in the removal state (i.e. when the removal chamber is closed and when the removal chamber is opened). By detaching the first portion of the covering foil, the removal chamber is opened and the substance made accessible. Preferably, the substance is taken up once or repeatedly or successively from the removal chamber using an applicator, which is advantageously also mounted in the packaging and removed therefrom, and applied to the target article, for example a patient's tooth. In particular, the repeated taking-up of substance from the removal chamber highlights the advantage of the invention that the detached first portion of the covering foil substantially maintains its shape and it does not recoil as a result of elastic deformation in the second portion of the covering foil, as soiling caused by substance residues adhering to the first portion of the covering foil is avoided or reduced. Specifically if the removal chamber contains the substance already in the storage state, i.e. also during transportation, the substance will, as a result of shaking and handling of the packaging, enter into contact with the covering foil and can adhere thereto.

A particularly preferred packaging according to the invention is configured as follows:

Packaging for storing a free-flowing, paste-like or powdery substance, consisting of or comprising a bottom foil and a covering foil which are sealed to each other at least in certain portions, and a removal chamber which is formed from regions of the bottom foil and the covering foil that are detachably sealed to one another at least in certain portions, wherein the removal chamber can be opened by detaching at least a first portion of the covering foil from the bottom foil, characterised in that a second portion, which is arranged adjacent to the first portion, of the covering foil displays less deformation resistance than the first portion of the covering foil, so that deformation, required for permanently opening the removal chamber, of the covering foil occurs substantially in the second portion of the covering foil, and the bottom foil is embodied as a deep-drawn foil and the removal chamber is embodied as a well in the bottom foil that is covered by the covering foil and the covering foil and the bottom foil are sealed to each other by a seal and the seal is embodied so as to be peelable at least between the first portion of the covering foil and the bottom foil, so that the first portion of the covering foil is detachable from the bottom foil.

This particularly preferred packaging according to the invention is preferably additionally characterised by an applicator chamber which is separated from the removal chamber and in which an applicator for applying the substance is releasably mounted, wherein the applicator chamber is formed from regions of the bottom foil and the covering foil that are detachably sealed to one another at least in certain portions.

And also additionally, this particularly preferred packaging according to the invention is preferably characterised in that the applicator chamber is arranged in such a way that by detaching the first portion of the covering foil, the applicator chamber can be opened sufficiently wide to allow the applicator to be removed, wherein the substance is stored in the removal chamber and the removal chamber is arranged in such a way that by detaching the first portion of the covering foil, the removal chamber can be opened at least sufficiently wide to allow the substance to be removed.

The features described hereinafter relate to a preferred alternative variant of a packaging according to the invention with a storage chamber. Preferably, this preferred alternative variant comprises a plurality of the further preferred features of the packaging according to the invention, as described hereinbefore.

An alternative packaging according to the invention comprises a storage chamber which contains the substance and is separated from the removal chamber and if appropriate the applicator chamber, wherein in a region connecting the storage chamber and the removal chamber, the bottom foil and the covering foil are connected by a seal in such a way that by exerting a pressure from the outside onto the storage chamber, the seal of the bottom and covering foil becomes detached in the connecting region and there is formed between the storage chamber and removal chamber a through-channel through which the substance can be transferred from the storage chamber wholly or partly to the removal chamber.

A specific pressure which is exerted by the user from the outside onto the storage chamber preferably leads to the seal in the region connecting the storage chamber to the removal chamber selectively becoming detached and to the formation of a through-channel through which the substance contained in the storage chamber is then transferred to the removal chamber. The transferred amount and speed of the transferral depend preferably on the strength and duration of the pressure exerted by the user from the outside onto the storage chamber. This has the advantage that the user can himself control the transferred amount and speed of the transferral by varying the pressure exerted by him onto the storage chamber.

The substance can be transferred to the closed or opened removal chamber. The latter procedure offers the advantage that the substance does not enter into contact with the first portion of the covering foil, which is already detached when the removal chamber is opened, and therefore cannot adhere to the detached first portion of the covering foil.

The above-described metering markings are particularly advantageous in relation to the preferred alternative variant described here of the packaging according to the invention, as they can be used by a user to meter the amount of the substance that is transferred from the storage chamber to the removal chamber.

The storage chamber is embodied preferably as a well in the bottom foil that is covered by the covering foil, preferably by the third portion of the covering foil.

The invention can furthermore be configured in that the storage chamber conventionally has a volume of from approx. 0.1 ml to 3 ml.

The substances used in dental technology are required conventionally in an amount of from approx. 0.05 ml to 0.2 ml for an application. The packaging has preferably chamber volumes which correspond to this amount or are correspondingly larger. In a preferred configuration, the chamber volume for substances to be provided in an amount of from approx. 0.05 ml to 0.2 ml is approx. 0.6 ml.

The storage chamber can be compressed preferably by a pressure which is exerted from the outside onto the storage chamber, preferably for transferring the substance contained in the storage chamber to the removal chamber.

Compression of the storage chamber by a pressure exerted, preferably by a user, from the outside onto the storage chamber has the advantage that in this way the substance is pressed from the storage chamber into the removal chamber and the storage chamber can easily be emptied.

The features described hereinafter develop the above-described preferred alternative variant of a packaging according to the invention with a storage chamber with regard to pressure marking.

The covering foil, preferably the third portion of the covering foil, has preferably a pressure marking which marks the storage chamber onto which a pressure is to be exerted from the outside.

A marking of this type has the advantage of displaying to a user directly the location of the packaging onto which the pressure is to be exerted, without the packaging having for example to be turned in order to locate the well of the storage chamber in the bottom foil.

Furthermore, it is particularly advantageous if the pressure marking is arranged in a strengthened region of the third portion of the covering foil, as strengthening of this type can prevent or impede damage to the third portion of the covering foil, such as can for example be produced during pressing-in of the storage chamber by sharp fingernails, without overall the handling of the covering foil, in particular the detachment of portions of the covering foil, being impeded.

The features described hereinafter develop the above-described preferred alternative variant of a packaging according to the invention with a storage chamber with regard to the embodiment of the seal. Preferably, this development of the preferred alternative variant is present at the same time as individual, or a plurality of the, further preferred developments of the packaging according to the invention.

The seal between the covering foil and bottom foil in the region connecting the storage chamber and the removal chamber is preferably weakened in such a way that by exerting a pressure from the outside onto the storage chamber, the seal becomes detached in the connecting region and there is formed between the storage chamber and removal chamber a through-channel through which the substance can be transferred from the storage chamber wholly or partly to the removal chamber.

The targeted weakening of the seal has the advantage that only the weakened seal is then selectively detached by an externally applied pressure and other, non-weakened sealing portions remain intact, so that a defined through-channel is formed. The position and/or geometry of the through-channel can be defined by targeted weakening.

Preferably, the seal between the covering foil and bottom foil is weakened in the region connecting the storage chamber and the removal chamber owing to one or more of the following measures:

- arranging foreign particles, preferably punched-out portions of peel foil, in the weakened sealing region;
- applying, before generating the seal, a substance limiting the sealing of the bottom foil and covering foil to the bottom foil and/or covering foil in the region to be weakened;
- generating the seal by welding the bottom foil and covering foil, wherein in the region connecting the storage chamber and the removal chamber, the welding temperature and/or the compressive pressure during welding and/or the welding time is different to that in adjacent regions;
- providing different seal geometries in (a) the region connecting the storage chamber and the removal chamber and (b) adjacent regions.

A person skilled in the art can select these and if appropriate further measures for the targeted weakening of the seal in specific regions in accordance with the materials to be used and the demands placed on the properties of the seal.

The through-channel of a corresponding packaging according to the invention has a cross section which advantageously widens toward the removal chamber.

This configuration can for example be realised by a corresponding arrangement of the weakened seal in the region connecting the storage chamber to the removal chamber. A widening of this type of the cross section of the through-channel helps to prevent or to reduce splashing of the substance as the substance issues from the through-channel.

The features described hereinafter develop the above-described preferred alternative variant of a packaging according to the invention with a storage chamber with regard to the arrangement and configuration of the removal chamber. Preferably, this development of the preferred alternative variant is present at the same time as one or more of the further preferred developments of the packaging according to the invention relating to different features.

The removal chamber is preferably arranged in such a way that it can be opened, by detaching the first portion of the covering foil, at least sufficiently wide to allow the substance to be transferred from the storage chamber to the removal chamber to be removed.

The substance can be transferred from the storage chamber to the removal chamber, for example before or after the opening of the removal chamber.

Preferably, a corresponding packaging is configured in such a way a first portion of the removal chamber is covered by the first portion of the covering foil and a second portion of the removal chamber is covered by the second portion of the covering foil, so that on detachment of the first portion of the covering foil, only the first portion of the removal chamber is opened, wherein the second portion of the removal chamber is preferably that portion of the removal chamber that adjoins the region connecting the removal chamber to the storage chamber.

This configuration has the advantage that spraying of the substance can be avoided or reduced on transferral thereof from the storage chamber to the removal chamber. In particular, this can prevent spraying upward, usually in the direction of a user handling the packaging during issuing from the through-channel, as a result of the fact that the portion of the removal chamber into which the through-channel discharges remains covered by the second portion of the covering foil even after the opening of the removal chamber. The substance, which may issue rapidly, is in this case guided on the protruding second portion of the covering foil in such a way that it enters the removal chamber in a targeted manner and does not spray out therefrom. The higher the viscosity of the substance to be transferred, the more forceful this effect.

The features described hereinafter develop the above-described preferred alternative variant of a packaging according to the invention with a storage chamber with regard to further storage chambers. Preferably, this development of the preferred alternative variant is present at the same time as one or more of the further preferred developments of the packaging according to the invention relating to different features.

A further preferred configuration of the invention is characterised by a second storage chamber containing a second free-flowing, paste-like or powdery substance, wherein in a region connecting the second storage chamber and an adjacent chamber, preferably the first storage chamber or the removal chamber, the bottom foil and the covering foil are connected by a seal in such a way that by exerting a pressure from the outside onto the second storage chamber, the seal of the bottom and covering foil becomes detached in the connecting region and there is formed between the second storage chamber and the adjacent chamber a through-channel through which the substance can be transferred from the second storage chamber wholly or partly to the adjacent chamber, so that a mixture of the first and second substance can be prepared in the adjacent chamber.

In dental technology, use is frequently made of substances which can be blended together only shortly before use thereof. In particular, in cases of this type, it is expedient to provide two substances in two separate chambers in a packaging and to bring said substances into contact with each other only shortly before application.

The seal between the covering foil and bottom foil in the region connecting the second storage chamber and the adjacent chamber is then preferably weakened in such a way that by exerting a pressure from the outside onto the second storage chamber, the seal becomes detached in the connecting region and there is formed between the second storage chamber and the adjacent chamber a through-channel through which the substance can be transferred from the second storage chamber wholly or partly to the adjacent chamber.

For example, the second substance can be transferred from the second storage chamber to the first storage chamber and blended there with the first substance, before the mixture of the first and second substance is transferred from the first storage chamber to the removal chamber. The first and second substances can however also each be transferred from the first or second storage chamber to the removal chamber via separate through-channels and blended only once in the removal chamber.

In this case, it is additionally preferred for the seal between the covering foil and bottom foil to be weakened in the region connecting the second storage chamber and the adjacent chamber owing to one or more of the above-described measures.

A further preferred configuration of the packaging according to the invention is characterised by at least one further storage chamber containing at least one further free-flowing, paste-like or powdery substance, wherein in at least one region connecting the further storage chamber(s) and one or more adjacent chamber(s), preferably the first or second storage chamber or the removal chamber, the bottom foil and the covering foil are connected by a seal in such a way that by exerting a pressure from the outside onto the further storage chamber(s), the seal of the bottom and covering foil becomes detached in the at least one connecting region and there is formed between the further storage chamber(s) and the adjacent chamber(s) a through-channel through which the substance(s) can be transferred from the further storage chamber(s) wholly or partly to the adjacent chamber(s), so that a mixture of a plurality of substances can be prepared in the adjacent chamber(s).

Obviously, the packaging according to the invention can have not only a first and optionally a second storage chamber, but rather also a third and if appropriate further storage chambers comprising a third or if appropriate further substances. The number and arrangement of the storage chambers are chosen preferably as a function of the substances to be applied and the properties thereof and also of the desired order during blending of the substances.

The present invention also relates to a collecting container for storing at least one free-flowing, paste-like or powdery substance which is characterised by a plurality of the above-described packagings according to the invention which are connected to one another, preferably separably.

A collecting container of this type according to the invention is advantageous in particular for transportation of and dealing with the packagings according to the invention, as an individual packaging according to the invention often contains, as described above, a substance only in an amount which is required for application in an individual patient and is thus usually very small. The combining of a plurality of packagings according to the invention to form a collecting container according to the invention simplifies the transportation, trading and dispensing thereof. Before they are used, the packagings can advantageously be isolated again.

In procedural terms, the invention relates to a method for storing a free-flowing, paste-like or powdery substance, including the following steps:

- providing an above-described packaging according to the invention,
- opening the removal chamber by detaching the first portion of the covering foil, wherein the plastic deformation, required for opening the removal chamber, of the covering foil occurs substantially in the second portion of the covering foil,
- if appropriate removing the applicator from the applicator chamber,
- if appropriate exerting a pressure from the outside onto the storage chamber, so that the seal of the bottom and covering foil becomes detached in the region connecting the storage chamber and the removal chamber and a through-channel is formed between the storage chamber and removal chamber, and also transferring the substance from the storage chamber wholly or partly to the removal chamber, and
- applying the substance contained in the removal chamber or transferred to the removal chamber using an applicator, wherein the applicator is preferably the applicator removed from the applicator chamber of the packaging.

Individual ones of the aforementioned steps can also be carried out in an order other than that specified hereinbefore.

Further configurations of the method according to the invention include steps which make them in particular suitable to use the packaging according to the invention and the configurations thereof. With regard to the embodiments, specific features, variants and advantages of the features of this method and the method configurations thereof, reference is made in particular to the foregoing description with regard to the corresponding packaging features.

The invention will be described hereinafter in greater detail based on advantageous embodiments and with reference to the appended figures, in which:

DETAILED DESCRIPTION OF THE INVENTION

Figure 1:
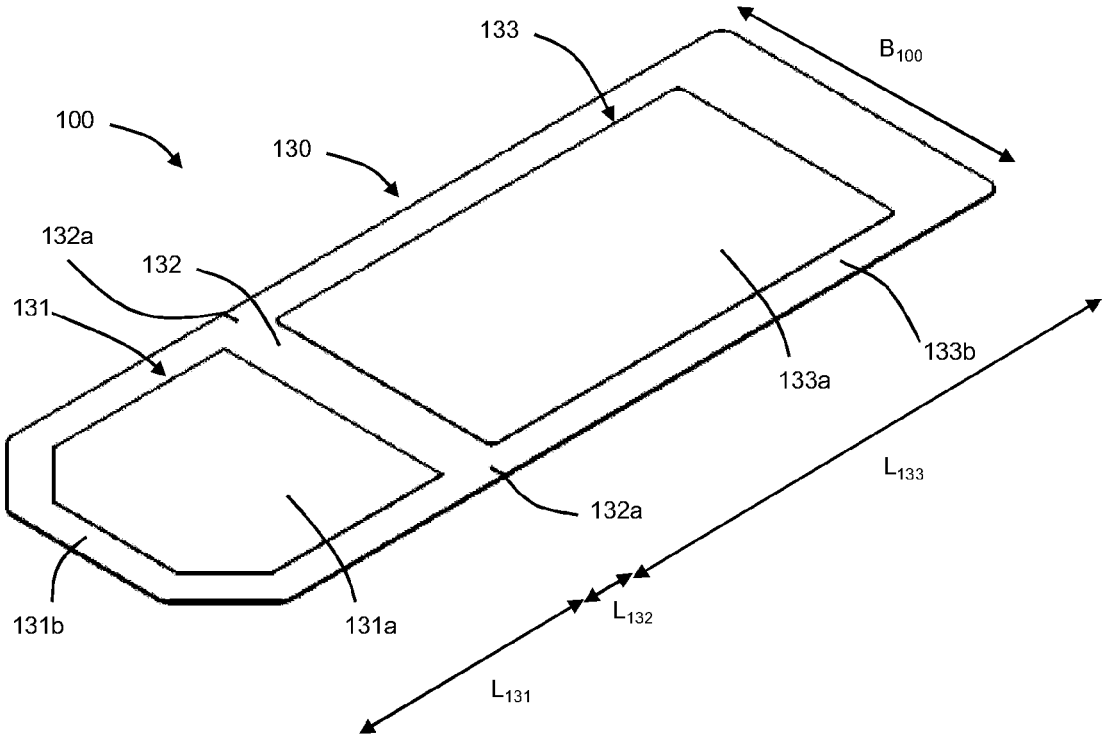
FIG. 1 is a three-dimensional view of a first embodiment of a packaging according to the invention in the closed state.

FIG. 1 is a three-dimensional view of a first embodiment of a packaging 100 according to the invention. The packaging 100 is embodied as a sanitary disposable packaging. FIG. 1 shows an upper side of the packaging 100 which is covered by a covering foil 130. The covering foil 130 has a first portion 131, a second portion 132 and a third portion 133. The second portion 132 of the covering foil lies between the first portion 131 and the third portion 133 of the covering foil. The three portions 131, 132, 133 each have the identical width $B_{100}$ auf. The second portion 132 is, at the length $L_{132}$, the shortest of the three portions 131, 132, 133. The first portion 131 is, at its length $L_{131}$, longer than the second portion 132, but shorter than the third portion 133 at its length $L_{133}$.

The covering foil 130 is an aluminum foil having a thickness of 20 μm. On its side pointing upward in FIG. 1, the aluminum foil is provided with a stoving enamel which serves as an anticorrosive. On its underside (which cannot be seen in FIG. 1), the covering foil is provided with a sealing layer made of peelable heat sealing lacquer of from approximately 2 to 8 μm. Optionally, the sealing layer can also consist of a polyolefin, for example polyethylene, polypropylene, polybutylene, polystyrene, polycarbonate, a similarly constructed hydrocarbon polymer or a copolymer of various polyolefins, having a thickness of less than 25 μm.

The sealing layer of the first portion 131 of the covering foil is connected to a corresponding portion of a sealing layer of a bottom foil (not shown in FIG. 1) by a peelable seal, i.e. a detachable seal.

Both the first portion 131 of the covering foil and the third portion 133 of the covering foil each have a central region 131*a*, 133*a* which is strengthened by a respective label 131*a*, 133*a*. The labels can be embodied as adhesive labels made of plastics material or paper. In the embodiment shown in FIG. 1 of the packaging, the adhesive label 133*a* of the third portion 133 of the covering foil is imprinted, the adhesive label 131*a* of the first portion 131 of the covering foil is non-imprinted. Both labels 131*a*, 133*a* are arranged on the side of the covering foil that points upward in FIG. 1, i.e. on the stoving enamel of the covering foil.

The second portion 132 of the covering foil has two perforations 132*a*. The perforations 132*a* do not extend over the entire width $B_{100}$ of the second portion 132 of the covering foil 130, but rather are arranged merely in outer edge regions of the second portion 132 of the covering foil 130. In this case, the first portion 131 of the covering foil 130 is sealed only in its central region 131*a* to the bottom foil (not shown in FIG. 1). The edge region 131*b* of the first portion 131 of the covering foil 130 rests on the bottom foil (not shown in FIG. 1) and is not sealed to said bottom foil.

Figure 2:
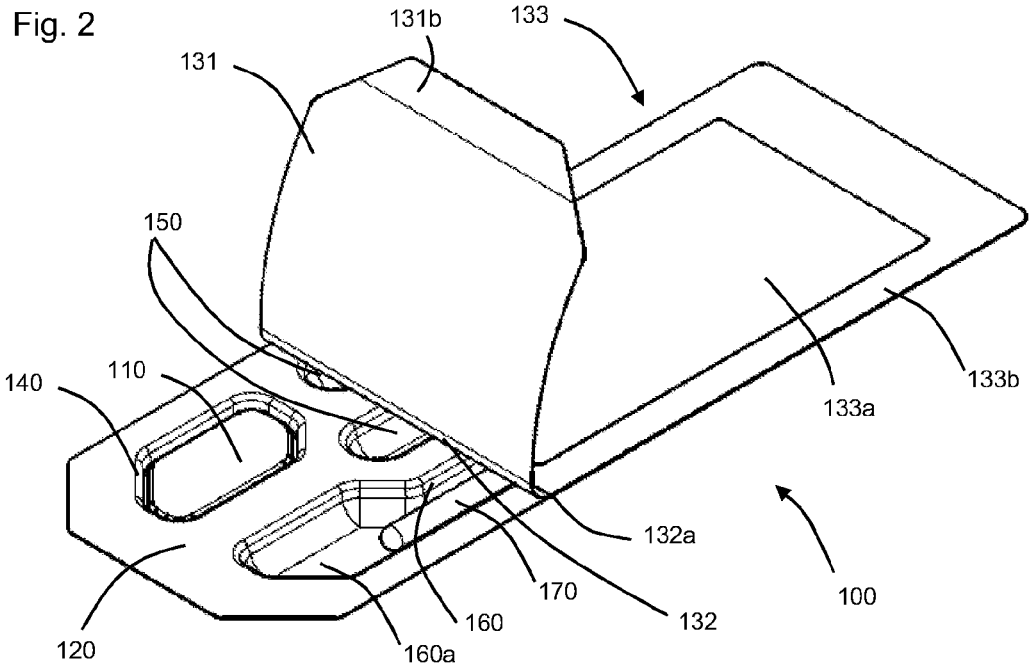
FIG. 2 is a three-dimensional view of the first embodiment shown in FIG. 1 of the packaging in the opened state.

FIG. 2 is a three-dimensional view of the embodiment shown in FIG. 1 of the packaging 100 in the opened state. Like FIG. 1, FIG. 2 shows the covering foil 130 with its three portions 131, 132, 133. In addition, the bottom foil 120 may be seen in FIG. 2. The bottom foil 120 is embodied as a composite foil. The composite foil has a first sealing layer which faces the covering foil 130, points upward in FIG. 2 and consists of polyolefin having a thickness of 60 μm. A blocking foil made of aluminum having a thickness of approx. 45 μm is arranged below the sealing layer. A laminating adhesive is preferably arranged, as an adhesion promoter, between the blocking foil and the sealing layer. Located below the blocking layer made of aluminum is an outer layer made of oriented polyamide having a thickness of 25 μm. A laminating adhesive is preferably also arranged, as an adhesion promoter, between the blocking foil and outer foil. The bottom foil 120 is embodied as a deep-drawn foil.

A removal chamber 140, containing a dental material 110 as the substance, is provided in the bottom foil 120. In the embodiment illustrated in FIG. 2, the dental material 110 is a fluoride varnish. Furthermore, a well, which serves as an applicator chamber 160, is formed in the bottom foil 120. An applicator 170 is releasably mounted in the applicator chamber 160. The applicator chamber 160 has a widened region 160*a*. Two stabilisation beads 150 are embodied as further wells in the deep-drawn foil 120.

The second portion 132 of the covering foil 130 displays, in the opened state of the packaging 100 illustrated in FIG. 2, plastic deformation along a buckling line running between the two perforations 132*a*.

The first portion 131 of the covering foil 130 can be seen in FIG. 2 in the opened state of the packaging 100 with its underside on which the sealing layer of the covering foil 130 is arranged.

Figure 3:
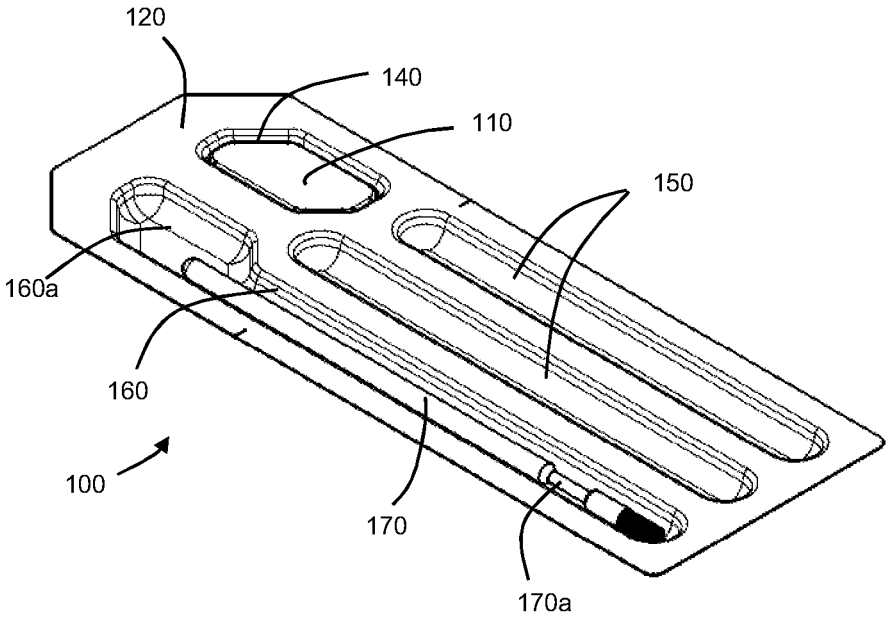
FIG. 3 is a three-dimensional view of the first embodiment shown in FIG. 1 of the packaging without a covering foil.

FIG. 3 is a three-dimensional view of the embodiment shown in FIG. 1 of the packaging 100 according to the invention without a covering foil. There may be seen therein the wells in the bottom foil 120 that have already been described with reference to FIG. 2: The removal chamber 140 containing a dental material 110 as the substance, the two stabilisation beads 150 and also the applicator chamber 160 with a widened region 160*a*. The applicator 170, which is arranged in the applicator chamber 160, may also be seen. In the example illustrated here, the applicator 170 is a swab. The swab 170 has a region 170*a* having a reduced cross section. This reduction in cross section can serve as a predetermined bending point to adapt the shape of the swab 170 to the application environment, such as for example a row of teeth in an oral cavity.

Figure 4:
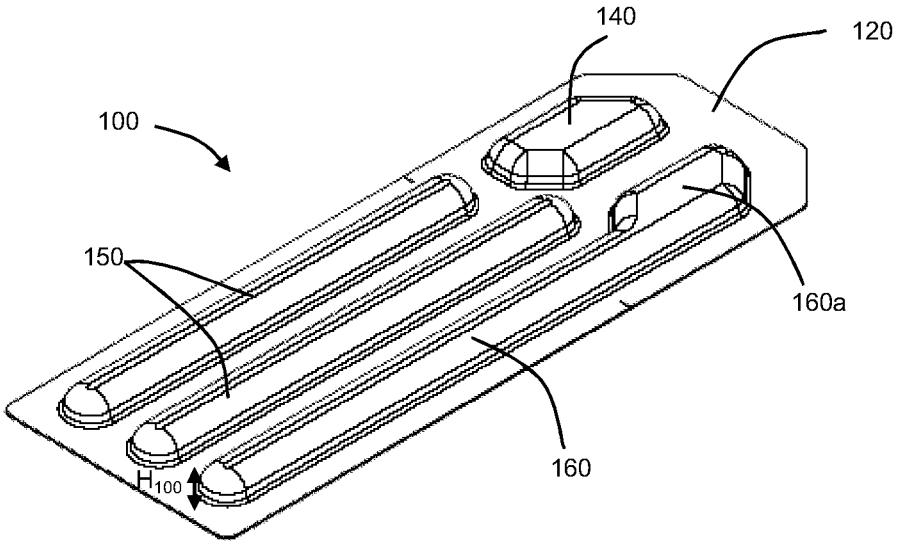
FIG. 4 is a three-dimensional view from below onto the first embodiment shown in FIG. 1 of the packaging.

FIG. 4 is a three-dimensional view from below of the embodiment illustrated in FIG. 1 of the packaging 100. In this case, the wells in the bottom foil 2 that have already been described with reference to FIGS. 2 and 3 may be seen from below: The removal chamber 140, the applicator chamber 160 having the widened region 160*a* and the two stabilisation beads 150. In this case, it may be seen that all of the aforementioned wells (removal chamber 140, applicator chamber 160, stabilisation beads 150) have substantially the same height $H_{100}$; this is in particular advantageous to set down the packaging 100 with its underside, which points upward in FIG. 4, on a substantially planar surface, such as for example a tray, before, during and/or after use thereof. The two stabilisation beads 150 help the packaging 100 as a whole to be able to be held in a substantially stable and thus secure manner. The stabilisation beads 150 are preferably not filled with a substance or a dental material, but rather remain empty.

Figure 5:
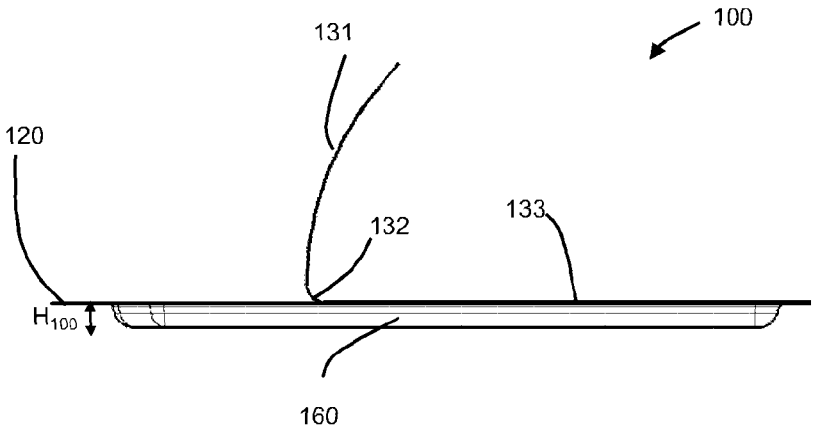
FIG. 5 is a side view of the first embodiment shown in FIG. 1 of the packaging in the opened state.

FIG. 5 shows the second portion 132, which is plastically deformed in the opened state, of the covering foil and also the first portion 131 of the covering foil that protrudes from the packaging substantially upward and is only slightly deformed in contrast to the second portion 132 of the covering foil.

Figure 6:
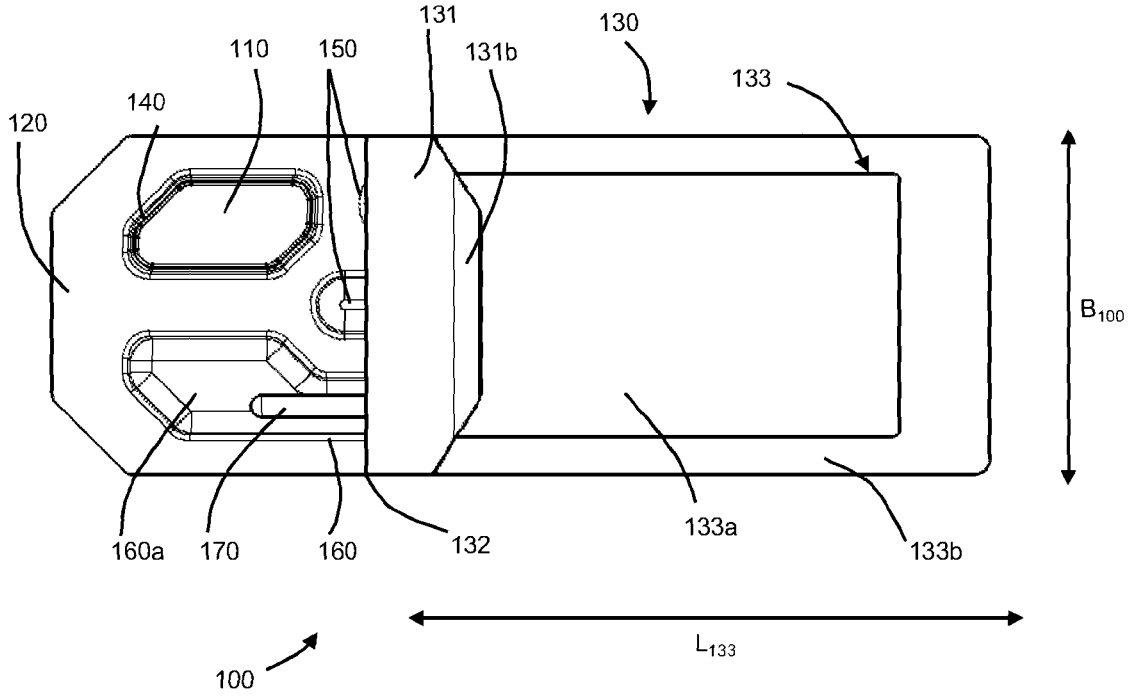
FIG. 6 is a plan view onto the first embodiment shown in FIG. 1 of the packaging in the opened state.

FIG. 6 is a plan view of the embodiment illustrated in FIG. 1 of the packaging 100 according to the invention in the opened state. There may be seen the third portion 133 of the covering foil 130 having its length $L_{133}$ and its width $B_{100}$. The third portion 133 of the covering foil has, as previously illustrated with reference to FIGS. 1 and 2, in its central region 133*a* an imprinted adhesive label.

Furthermore, there may also be seen the bottom foil 120 with the wells described hereinbefore with reference to FIGS. 1 to 4, specifically the removal chamber 140, which contains as the substance the dental material 110, in the present case a fluoride varnish, the applicator chamber 160 having the widened region 160*a*, and the applicator 170 mounted in the applicator chamber 160 and also the two stabilisation beads 150.

The manner in which the first embodiment illustrated in FIGS. 1 to 6 of the packaging 100 according to the invention is to be handled will be described hereinafter. In the storage state, the packaging 100 is closed as illustrated in FIG. 1. In order to be able to remove and apply the substance stored in the packaging, the removal chamber 140 must be opened. This takes place, in the first embodiment illustrated here of the packaging 100, in that a user grips the edge region 131*b*, which is not sealed to the bottom foil 120, of the first portion 131 of the covering foil 130, which edge region displays less deformation resistance than the central region 131*a* of the covering foil. This edge region 131*b* acts in this example as a detachment aid or peeling tab. When a user has gripped this edge region 131*b*, he detaches the first portion 131 of the covering foil 130 from the bottom foil 120. During detachment, the first portion 131 of the covering foil can undergo deformation (for example roll up), although preferably at least a portion, preferably a substantial portion, of the deformation of the first portion 131 of the covering foil is resiliently reformed after the opening. A substantial portion of the plastic deformation, required for opening, of the covering foil 130 occurs along the buckling line, resulting between the perforations 132*a*, in the second portion 132. The deformation resulting in this case in the second portion 132 of the covering foil is at least substantially plastic deformation, that is to say that the deformation in the second portion 132 is resiliently reformed at most slightly.

The packaging 100 opened in this way 100 is illustrated in FIG. 2. The illustration of the first portion 131 of the covering foil in FIG. 2 is schematic; in actual use of a packaging according to the invention, allowance must be made for partly also plastic deformation of the first portion 131 of the covering foil in the opened state. It may be seen that after the detachment of the first portion 131 of the covering foil from the bottom foil 120, the removal chamber 140 comprising the dental material 110 is accessible and furthermore the widened region 160*a* of the applicator chamber 160 is exposed.

The user can now grip the applicator 170 and remove it from the packaging. The widened region 160*a* of the applicator chamber 160 makes it easier for the user to grip the applicator 170. The user can now use the applicator to apply the dental material 110 to a target object, for example a patient's tooth. In this case, the packaging 100 can selectively be set down on a substantially planar surface, for example a tray, or the packaging 100 can be held in the user's hand during the application. The handling of the packaging, during which the underside of the first portion 131 of the sealing foil can be provided with adhesions of the dental material 110, is improved inter alia as a result of the fact that the deformation occurring in the second portion 132 is substantially plastic, and the first portion 131 of the covering foil undergoes less intensive plastic deformation.

Optionally, the seal between the second portion 132 of the covering foil and the bottom foil 120 and if appropriate also between the third portion 133 of the covering foil and the bottom foil 120 can be embodied in such a way that the covering foil 130 can be completely detached from the bottom foil 120 and removed.

Advantageously, however, the covering foil 130 remains connected to the bottom foil 120 at least in certain portions, so that the user can dispose of the packaging 100, after completion of the application of the dental material 110, in one piece and thus in one operation.

FIGS. 7 to 11 show a second embodiment of a packaging 200 according to the invention. The second embodiment of the packaging 200 is similar in many configurational details to those of the first embodiment of the packaging 100. Therefore, above all the main differences of the second embodiment of the packaging 200 will be illustrated in detail hereinafter. For the further configurational details and variants which are substantially identical to those of the first embodiment, reference is made to the description with respect to FIGS. 1 to 6.

The second embodiment of the packaging 200 according to the invention has a covering foil 230 with a first portion 231, a second portion 232 and a third portion 233. The first and the third portion of the covering foil 231, 233 each have in their central regions 231*a*, 233*a* an adhesive label. The construction of the covering foil 230 corresponds to the construction of the covering foil 130 of the first embodiment of the invention, as described in the description with reference to FIGS. 1 to 6. The second portion 232 of the covering foil has perforations 232*a*.

As may be seen in FIGS. 8 to 11, the packaging 200 additionally has a bottom foil 220 which is constructed in accordance with the bottom foil 120, which has been described with reference to FIGS. 1 to 6, of the packaging 100. The bottom foil 220 has a removal chamber 240, a storage chamber 290, an applicator chamber 260 having a widened region 160*a*, and two stabilisation beads 250. An applicator 270 is releasably mounted in the applicator chamber 260.

The covering foil 230 and the bottom foil 220 are sealed to each other by their sealing layers in such a way that at least the first portion 231 of the covering foil can be detached from the bottom foil, i.e. the first portion 231 of the covering foil is peelably sealed to the bottom foil 220.

Figure 7:
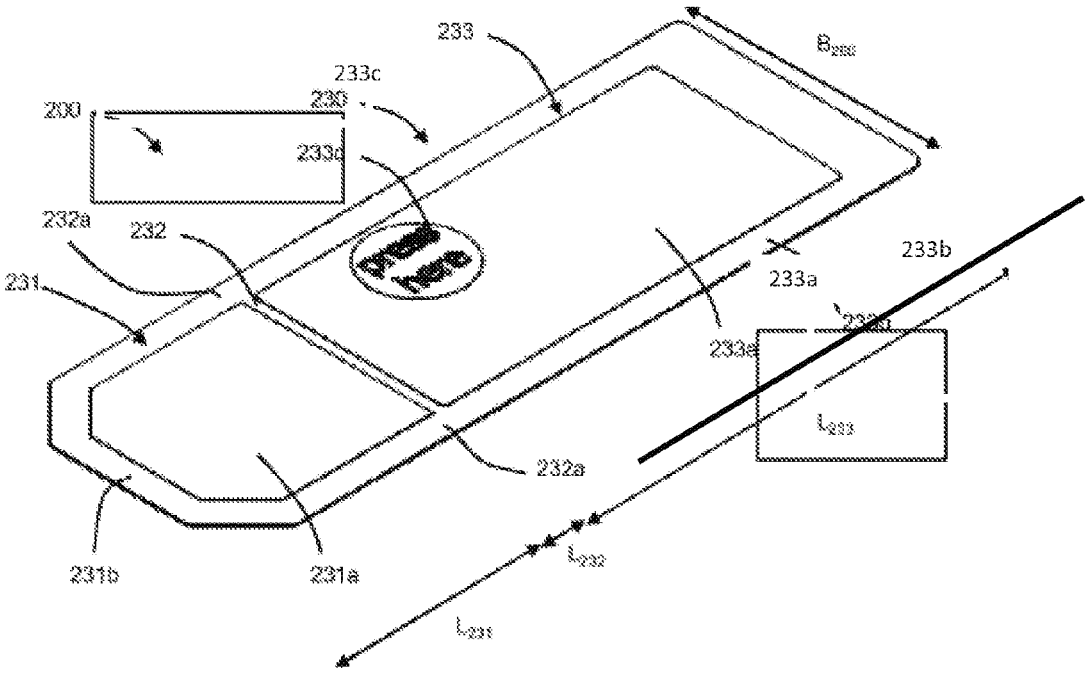
FIG. 7 is a three-dimensional view of a second embodiment of a packaging according to the invention in the closed state.
Figure 8:
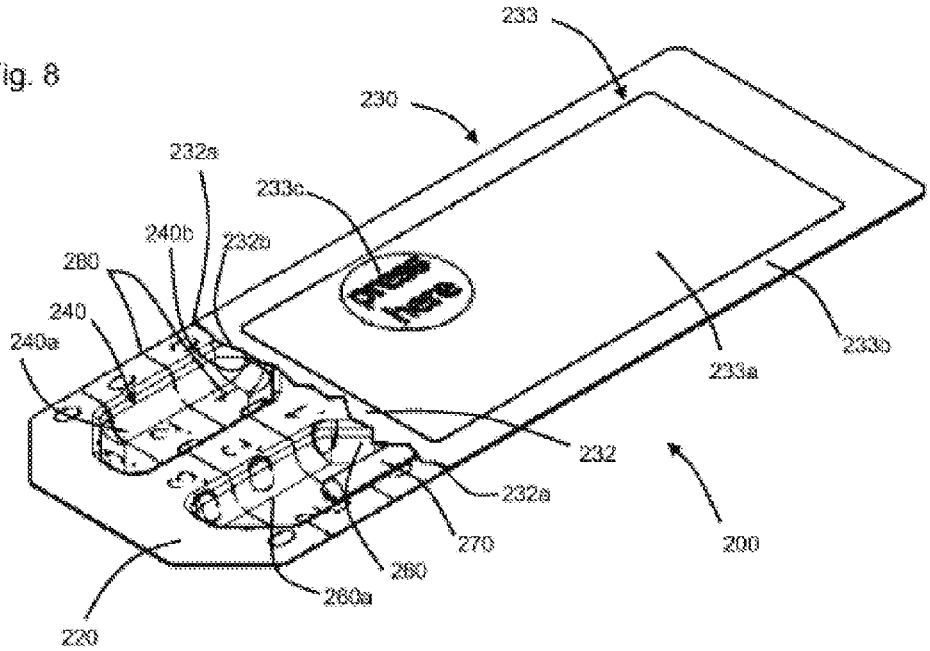
FIG. 8 is a three-dimensional view of the second embodiment shown in FIG. 7 of the packaging in the opened state.
Figure 9:
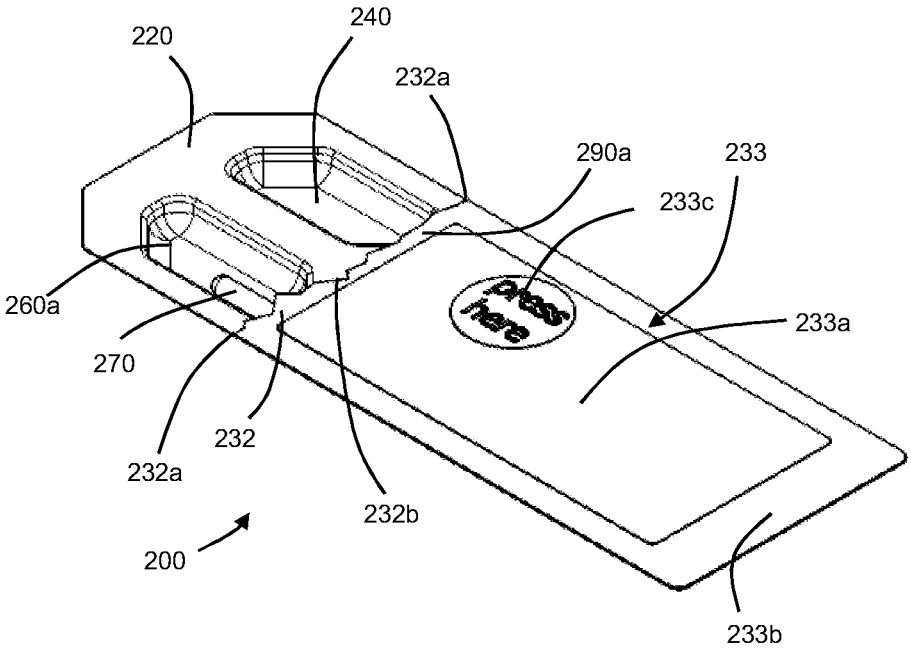
FIG. 9 is a further three-dimensional view of the second embodiment shown in FIG. 7 of the packaging in the opened state.
Figure 10:
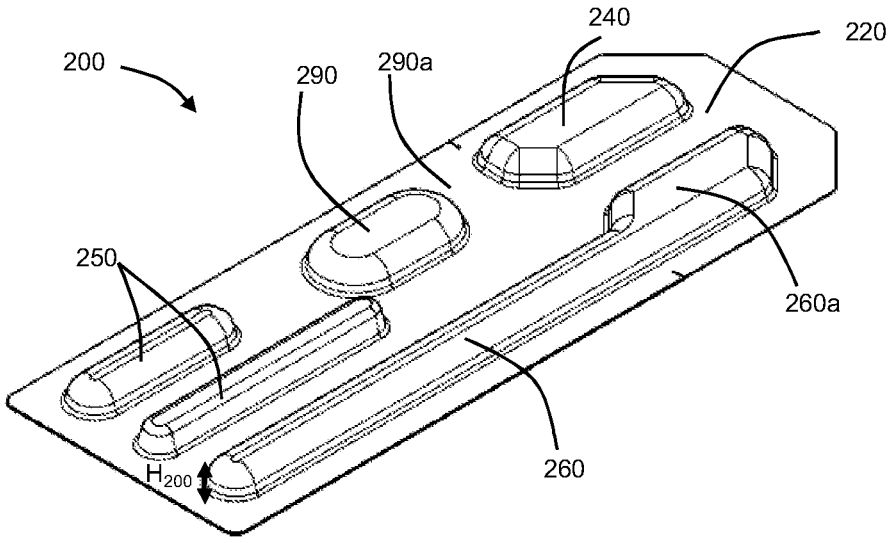
FIG. 10 is a three-dimensional view from below onto the second embodiment shown in FIG. 7 of the packaging.
Figure 11:
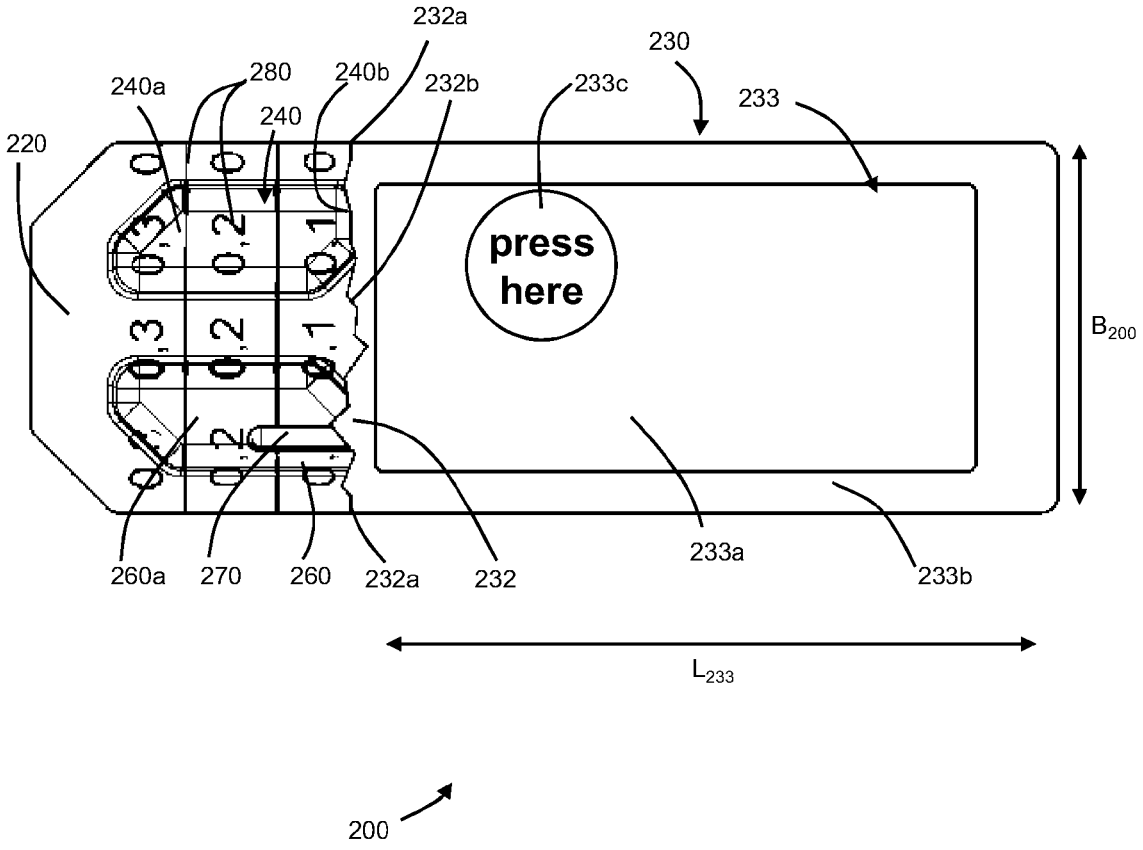
FIG. 11 is a plan view onto the second embodiment shown in FIG. 7 of the packaging in the opened state.

FIG. 7 is a three-dimensional view of the second embodiment of the packaging 200 according to the invention. In the third portion 233 of the covering foil 230, a pressure marking 233*c* is located on the label 233*a*. This pressure marking 233*c* may also be seen in FIGS. 8, 9 and 11. It is located above a storage chamber 290 which may be seen in FIGS. 9 and 10. In the second embodiment illustrated in FIGS. 7 to 11 of the packaging 200, the substance is, in contrast to the first embodiment shown in FIGS. 1 to 6, mounted not in the removal chamber but rather in the storage chamber 290. The substance itself is not shown in FIGS. 7 to 11. As may be seen in FIG. 10, the second embodiment of the packaging 200 also has stabilisation beads 250, although these are shorter than the stabilisation beads 150 of the first embodiment of the packaging 100.

In a region 290*a* connecting the removal chamber 240 to the storage chamber 290, the seal between the covering foil 230 and bottom foil 220 is weakened.

The weakening in the connecting region 290*a* can be brought about by one of the following measures:

- arranging foreign particles, preferably punched-out portions of peel foil, in the weakened sealing region;
- applying, before generating the seal, a substance limiting the sealing of the bottom foil and covering foil to the bottom foil and/or covering foil in the region to be weakened;
- generating the seal by welding the bottom foil and covering foil, wherein in the region connecting the storage chamber and the removal chamber, the welding temperature and/or the compressive pressure during welding and/or the welding time is different to that in adjacent regions;
- providing different seal geometries in (a) the region connecting the storage chamber and the removal chamber and (b) adjacent regions.

The removal chamber 240 has markings 280 which serve to meter the substance to be transferred from the storage chamber 290 to the removal chamber 240. The markings 280 have dashes which are provided with specified figures which specify what amount of substance is contained in the event of filling of the removal chamber 240 up to the respective dash of the marking 280. Additionally or alternatively, the markings 280 can contain also coloured markings and/or text. Furthermore, the markings can be overprinted or impressed. In the exemplary embodiment shown in FIGS. 8 and 11, the marking is applied over the entire width $B_{200}$ of the packaging. It is however also possible to apply the marking only in the region of the removal chamber 240 or only a portion of the removal chamber 240. In principle, the marking 280 can be configured in any desired manner, provided that it allows metering of the amount of the substance to be transferred from the storage chamber 290 to the removal chamber 240.

The second embodiment of the packaging 200 according to the invention is handled as described hereinafter. In the edge region 231*b* of the first portion 231 of the covering foil 230, which has not settled on the bottom foil 220, a user grips the covering foil 230 and detaches the first portion of the covering foil 231 from the bottom foil 220. In this case, plastic deformation occurs in the region 232 of the covering foil 230. The user generates a tear 232*b* through the second portion 232 of the covering foil with the aid of the perforation 232*a*. As a result, the first portion 231 of the covering foil is separated off and can be disposed of.

The removal chamber 240 is in this case arranged in such a way that as a result of the detachment of the first portion 231 of the covering foil, merely a first portion 240*a* of the removal chamber 240 is exposed. A second portion 240*b* of the removal chamber 240 remains below the second portion 232 of the covering foil.

In addition, as a result of the detachment of the first portion 231 of the covering foil, the widened region 260*a* of the applicator chamber 260 is exposed, so that the user can easily remove the applicator 270.

The user exerts in a further step a pressure from the outside onto the removal chamber 290. In this case, the user uses preferably his thumb and index finger to exert a pressure from above onto the pressure marking 233*c*, which is arranged above the storage chamber 290, on the covering foil and his thumb and index finger to exert a pressure from below onto the storage chamber 290. As a result of this pressure exerted from the outside onto the storage chamber 290, the seal in the connecting region 290*a* becomes detached, so that a through-channel between the storage chamber 290 and the removal chamber 240 is formed and the substance can be transferred from the storage chamber 290 to the removal chamber 240. The label 233*a* of the third portion 233 of the covering reduces in this case advantageously the risk of damage to the covering foil 230 for example as a result of sharp fingernails during pressing-in of the storage chamber.

The amount of the substance to be transferred depends in this case on the pressure exerted onto the storage chamber 290. The user can therefore control, by varying his pressure on the storage chamber 290, the amount and the speed of the substance to be transferred to the removal chamber 240. In this case, it has been found to be advantageous for the second portion 240*b*, which adjoins the connecting region 290*a* and the through-channel embodied thereon between the removal chamber and the storage chamber, to continue to remain covered by the second portion 232*b* of the covering foil, as in this way splashing of the substance can be prevented. The user can tell from the markings 280 how much substance he has transferred from the storage chamber 290 to the removal chamber 240. If only a specific amount of substance is required (for example in the treatment of children), the transferral of substance from the storage chamber 290 to the removal chamber 240 can be broken off in that the user stops exerting pressure onto the storage chamber 290. The desired amount, which is now located in the removal chamber 240, of the substance to be applied can subsequently be used. Preferably, the applicator 270, in this case a swab, which is also mounted in the packaging 200 is used for this purpose. Once the desired and required amount of substance has been applied, the packaging 200 can be disposed of.

Further preferred embodiments will be described hereinafter:

1. Packaging 100, 200 for storing a free-flowing, paste-like or powdery substance 110, consisting of or comprising
   - a bottom foil 120, 220 and a covering foil 130, 230 which are sealed to each other at least in certain portions, and
   - a removal chamber 140, 240 which is formed from regions of the bottom foil and the covering foil that are detachably sealed to one another at least in certain portions, wherein
   - the removal chamber can be opened by detaching at least a first portion 131, 231 of the covering foil from the bottom foil, characterised in that
   - a second portion 132, 232, which is arranged adjacent to the first portion, of the covering foil displays less deformation resistance than the first portion of the covering foil, so that deformation, required for permanently opening the removal chamber, of the covering foil occurs substantially in the second portion of the covering foil.

2. Packaging 100, 200 according to embodiment 1,
characterised in that the deformation occurring in the second portion 132, 232 of the covering foil 130, 230 during opening of the removal chamber 140, 240 is substantially plastic deformation.

3. Packaging 100, 200 according to one of embodiments 1 to 2,
characterised in that the deformation occurring in the second portion 132, 232 of the covering foil 130, 230 during opening of the removal chamber 140, 240 displays a higher proportion of plastic deformation than the deformation occurring in the first portion 131, 231 of the covering foil during opening of the removal chamber.

4. Packaging 100, 200 according to one of embodiments 1 to 3,
characterised in that the second portion 132, 232 of the covering foil is arranged between the first portion 131, 231 of the covering foil and a third portion 133, 233 of the covering foil and the second portion of the covering foil displays less deformation resistance than the third portion of the covering foil.

5. Packaging 100, 200 according to one of embodiments 1 to 4,
characterised in that the covering foil 130, 230 comprises a blocking foil, preferably a blocking foil made of metallic material, for example an aluminum foil having a thickness of approximately 20 mm, or consists thereof.

6. Packaging 100, 200 according to one of embodiments 1 to 5,
characterised in that the covering foil 130, 230 has in the first and/or in the third portion 131, 231, 133, 233 a reinforcement layer, preferably made of plastics material or paper.

7. Packaging 100, 200 according to one of embodiments 1 to 6,
characterised in that the covering foil 130, 230 is provided on its side remote from the bottom foil 120, 220 with an anticorrosive, preferably a stoving enamel, and/or on its side facing the bottom foil with a sealing layer, wherein the sealing layer is preferably a peelable heat sealing lacquer having a thickness of from approximately 2 to 8 mm or polyolefin having a thickness of less than 25 mm.

8. Packaging 100, 200 according to one of embodiments 1 to 7,
characterised in that the bottom foil 120, 220 is embodied as a composite foil, wherein the composite foil preferably comprises:

a sealing layer facing the covering foil 130, 230, for example polyolefin having a thickness of approximately 60 μm, a blocking foil, for example aluminum foil having a thickness of approximately 45 μm, an outer foil which is remote from the covering foil, for example oriented polyamide having a thickness of approximately 25 μm, wherein an adhesion promoter, for example a laminating adhesive, is arranged preferably between the sealing layer and blocking foil and/or the blocking foil and outer foil, and wherein the sealing layer, the blocking foil and the outer foil are arranged preferably in the specified order.

9. Packaging 100, 200 according to one of embodiments 1 to 8,
characterised in that the bottom foil 120, 220 is embodied as a deep-drawn foil.

10. Packaging 100, 200 according to one of embodiments 1 to 9,
characterised in that the removal chamber 140, 240 is embodied as a well in the bottom foil 120, 220 that is covered by the covering foil 130, 230.

11. Packaging 100, 200 according to one of embodiments 1 to 10,
characterised in that the covering foil 130, 230 and the bottom foil 120, 220 are sealed to each other by a seal.

12. Packaging 100, 200 according to embodiment 11,
characterised in that the seal is embodied so as to be peelable at least between the first portion 131, 231 of the covering foil and the bottom foil 120, 220, so that the first portion of the covering foil is detachable from the bottom foil.

13. Packaging 100, 200 according to one of embodiments 11 to 12,
characterised in that the seal between the covering foil 130, 230 and bottom foil 120, 220 displays differing sealing strengths in certain portions.

14. Packaging 100, 200 according to embodiment 13,
characterised in that the seal between the second portion 132, 232 and/or the third portion of the covering foil and the bottom foil 120, 220 displays a higher strength than the seal between the first portion 131, 231 of the covering foil and the bottom foil.

15. Packaging 100, 200 according to one of embodiments 13 to 14,
characterised in that the seal between the covering foil 130, 230 and bottom foil 120, 220 is embodied so as to be peelable in certain portions and so as not to be peelable in certain portions.

16. Packaging 200 according to one of embodiments 1 to 15,
characterised in that the first portion 131, 231 of the covering foil and the third portion 133, 233 of the covering foil can be separated from each other after the opening of the removal chamber 240 by generating a tear 232*b* in the second portion 132, 232 of the covering foil.

17. Packaging 100, 200 according to embodiment 16,
characterised in that the second portion 132, 232 of the covering foil has a tear aid or perforation 132*a*, 232*a* which facilitates the generating of the tear 232*b* in the second portion, wherein the tear aid or perforation is embodied preferably over the entire width B100, B200, only over a portion of the width or only in an edge region of the second portion.

18. Packaging 100, 200 according to one of embodiments 16 to 17,
characterised in that a boundary between the third portion of the covering foil and the second portion 132, 232 of the covering foil is embodied as a reference tear line in such a way that the crack 232*b* in the second portion of the covering foil is formed substantially parallel to the boundary between the third portion of the covering foil and the second portion of the covering foil.

19. Packaging 100, 200 according to one of embodiments 1 to 18,
characterised by an applicator chamber 160, 260 which is separated from the removal chamber 140, 240 and in which an applicator 170, 270 for applying the substance is releasably mounted, wherein the applicator chamber is formed from regions of the bottom foil 120, 220 and the covering foil 130, 230 that are detachably sealed to one another at least in certain portions.

20. Packaging 100, 200 according to embodiment 19,
characterised in that the applicator chamber 160, 260 is arranged in such a way that by detaching the first portion 131, 231 of the covering foil, the applicator chamber can be opened sufficiently wide to allow the applicator 170, 270 to be removed.

21. Packaging 200 according to one of embodiments 1 to 20,
characterised in that the removal chamber 240 has one, two or more markings 280 for metering the substance to be removed from the removal chamber.

22. Packaging 100 according to one of embodiments 1 to 21,
characterised in that the substance 110 is stored in the removal chamber 140 and the removal chamber is arranged in such a way that by detaching the first portion 131 of the covering foil, the removal chamber can be opened at least sufficiently wide to allow the substance to be removed.

23. Packaging 200 according to one of embodiments 1 to 21,
characterised by a storage chamber 290 which contains the substance and is separated from the removal chamber 240 and if appropriate the applicator chamber 260, wherein in a region 290*a* connecting the storage chamber and the removal chamber, the bottom foil 220 and the covering foil 230 are connected by a seal in such a way that by exerting a pressure from the outside onto the storage chamber, the seal of the bottom and covering foil becomes detached in the connecting region and there is formed between the storage chamber and removal chamber a through-channel through which the substance can be transferred from the storage chamber wholly or partly to the removal chamber.

24. Packaging 200 according to embodiment 23,
characterised in that the seal between the covering foil 230 and bottom foil 220 in the region 290*a* connecting the storage chamber 290 and the removal chamber 240 is weakened in such a way that by exerting a pressure from the outside onto the storage chamber, the seal becomes detached in the connecting region and there is formed between the storage chamber and removal chamber a through-channel through which the substance can be transferred from the storage chamber wholly or partly to the removal chamber.

25. Packaging 200 according to one of embodiments 23 to 24,
characterised in that the through-channel has a cross section widening toward the removal chamber 240.

26. Packaging 200 according to one of embodiments 23 to 25,
characterised in that the removal chamber 240 is arranged in such a way that by detaching the first portion 231 of the covering foil, the removal chamber can be opened at least sufficiently wide to allow the substance to be transferred from the storage chamber 290 to the removal chamber 240 to be removed.

27. Packaging 200 according to embodiment 26, characterised in that a first portion 240*a* of the removal chamber is covered by the first portion 231 of the covering foil and a second portion 240*b* of the removal chamber is covered by the second portion 232 of the covering foil, so that on detachment of the first portion of the covering foil, only the first portion of the removal chamber is opened, wherein the second portion of the removal chamber is preferably that portion of the removal chamber that adjoins the region 290*a* connecting the removal chamber 240 to the storage chamber 290.

28. Packaging according to one of embodiments 23 to 27, characterised by a second storage chamber containing a second free-flowing, paste-like or powdery substance, wherein in a region connecting the second storage chamber and an adjacent chamber, preferably the first storage chamber or the removal chamber, the bottom foil and the covering foil are connected by a seal in such a way that by exerting a pressure from the outside onto the second storage chamber, the seal of the bottom and covering foil becomes detached in the connecting region and there is formed between the second storage chamber and the adjacent chamber a through-channel through which the substance can be transferred from the second storage chamber wholly or partly to the adjacent chamber, so that a mixture of the first and second substance can be prepared in the adjacent chamber.

29. Collecting container for storing at least one free-flowing, paste-like or powdery substance, characterised by a plurality of packagings 100, 200 according to one of embodiments 1 to 28, which are connected to one another, preferably separably.

30. Method for storing and applying a free-flowing, paste-like or powdery substance, including the following steps:

providing a packaging 100, 200 according to one of embodiments 1 to 28, opening the removal chamber 140, 240 by detaching the first portion 131, 231 of the covering foil 130, 230, wherein the plastic deformation, required for opening the removal chamber, of the covering foil occurs substantially in the second portion 132, 232 of the covering foil, if appropriate removing the applicator 170, 270 from the applicator chamber 160, 260, if appropriate exerting a pressure from the outside onto the storage chamber 290, so that in the region 290*a* connecting the storage chamber and the removal chamber, the seal of the bottom and covering foil becomes detached and a through-channel is formed between the storage chamber and removal chamber, and also transferring the substance from the storage chamber wholly or partly to the removal chamber, and applying the substance contained in the removal chamber or transferred to the removal chamber using an applicator, wherein the applicator is preferably the applicator removed from the applicator chamber of the packaging.

The invention claimed is:

1. Packaging (100, 200) for storing a free-flowing, paste-like or powdery substance (110), comprising a bottom foil (120, 220) and a covering foil (130, 230) which are sealed to each other at least in certain portions, a removal chamber (140, 240) which is formed in a first portion proximate a front edge of the bottom foil and the covering foil having a bottom surface with a first portion detachably sealed to the first portion of the bottom foil around the removal chamber, and an applicator chamber (160, 260) laterally spaced from said removal chamber, wherein a portion of said applicator chamber is laterally adjacent to and extends behind said removal chamber, wherein the removal chamber can be opened by detaching said first portion (131, 231) of the covering foil from the bottom foil, the first portion of the covering foil overlying at least a portion of the removal chamber, a second portion (132, 232) of the bottom surface of said covering foil arranged adjacent to and behind the first portion of the covering foil and overlying and sealed to a second portion of the bottom foil adjacent to and behind a back edge of said removal chamber, and a third portion of the bottom surface of the covering foil adjacent to and behind said second portion of the covering foil to define the second portion between the first portion and third portion, said third portion being sealed to said bottom foil around a portion of the applicator chamber, wherein said second portion of said covering foil displays less deformation resistance than the first portion of the covering foil, so that deformation upon permanently opening of the removal chamber, of the covering foil occurs substantially in the second portion of the covering foil relative to the first portion of the covering foil, and the covering foil having a blocking layer made of metallic material, wherein the deformation resistance of the second portion of the covering foil is lower than the deformation resistance of the first portion of the covering foil and is realized by strengthening in the region of the first portion of the covering foil by a reinforcement layer formed of plastic material or paper on a top surface of the first portion of the covering foil, wherein the reinforcement layer completely covers said removal chamber when said covering foil is sealed to said bottom foil.

2. Packaging (100, 200) according to claim 1, wherein the deformation occurring in the second portion (132, 232) of the covering foil (130, 230) during opening of the removal chamber (140, 240) is substantially plastic deformation.

3. Packaging (100, 200) according to claim 1, wherein the deformation occurring in the second portion (132, 232) of the covering foil (130, 230) during opening of the removal chamber (140, 240) displays a higher proportion of plastic deformation than the deformation occurring in the first portion (131, 231) of the covering foil during opening of the removal chamber.

4. Packaging (100, 200) according to claim 1, wherein the second portion (132, 232) of the covering foil is arranged between the first portion (131, 231) of the covering foil and said third portion (133, 233) of the covering foil and the second portion of the covering foil displays less deformation resistance than the third portion of the covering foil, wherein the third portion comprises a reinforcement layer formed of plastic material or paper on a top surface of the third portion of the covering foil said first portion of said covering foil formed at a first end of said covering foil and said second and third portions of said covering foil spaced from said first end.

5. Packaging (200) according to claim 4, wherein the first portion (131, 231) of the covering foil and the third portion (133, 233) of the covering foil can be separated from each other after the opening of the removal chamber (240) by generating a tear (232*b*) in the second portion (132, 232) of the covering foil.

6. Packaging (100, 200) according to claim 5, wherein the second portion (132, 232) of the covering foil has a tear aid or perforation (132*a*, 232*a*) which facilitates the generating of the tear (232*b*) in the second portion.

7. Packaging (100, 200) according to claim 5, wherein a boundary between the third portion of the covering foil and the second portion (132, 232) of the covering foil is a reference tear line in such a way that the tear (232*b*) in the second portion of the covering foil is formed substantially parallel to the boundary between the third portion of the covering foil and the second portion of the covering foil.

8. Packaging (100, 200) according to claim 1, wherein the covering foil (130, 230) comprises a blocking foil made of an aluminium foil.

9. Packaging (100, 200) according to claim 1, wherein the covering foil (130, 230) is provided on its side remote from the bottom foil (120, 220) with an anticorrosive and on its side facing the bottom foil with a sealing layer.

10. Packaging (100, 200) according to claim 1, wherein the bottom foil (120, 220) is a deep-drawn foil.

11. Packaging (100, 200) according to claim 1, wherein the removal chamber (140, 240) is a well in the bottom foil (120, 220) that is covered by the covering foil (130, 230).

12. Packaging (100, 200) according to claim 1, wherein the covering foil (130, 230) and the bottom foil (120, 220) are sealed to each other by a seal.

13. Packaging (100, 200) according to claim 12, wherein the seal is peelable at least between the first portion (131, 231) of the covering foil and the bottom foil (120, 220), so that the first portion of the covering foil is detachable from the bottom foil with the second portion of the covering foil sealed to said bottom foil.

14. Packaging (100, 200) according to claim 12, wherein the seal between the covering foil (130, 230) and bottom foil (120, 220) displays differing sealing strengths in certain portions.

15. Packaging (100, 200) according to claim 14, wherein the seal between the second portion (132, 232) and the bottom foil (120, 220) displays a higher strength than the seal between the first portion (131, 231) of the covering foil and the bottom foil.

16. Packaging (100, 200) according to claim 14, wherein the seal between the covering foil (130, 230) and bottom foil (120, 220) is peelable in certain portions and so as not to be peelable in certain portions.

17. Packaging (100, 200) according to claim 1, wherein an applicator (170, 270) for applying the substance releasably mounted in the applicator chamber (160,260), wherein the applicator chamber is formed from regions of the bottom foil (120, 220) and the covering foil (130, 230) that are detachably sealed to one another at least in certain portions.

18. Packaging (100, 200) according to claim 17, wherein the applicator chamber (160, 260) is arranged in such a way that by detaching the first portion (131, 231) of the covering foil, the applicator chamber can be opened sufficiently wide to allow the applicator (170, 270) to be removed.

19. Packaging (200) according to claim 1, wherein the removal chamber (240) has one, two or more markings (280) for metering the substance to be removed from the removal chamber.

20. Packaging (100) according to claim 1, wherein the substance (110) is stored in the removal chamber (140) and the removal chamber is arranged in such a way that by detaching the first portion (131) of the covering foil, the removal chamber can be opened at least sufficiently wide to allow the substance to be removed.

21. Packaging (200) according to claim 1, wherein a storage chamber (290) which contains the substance and is separated from the removal chamber (240), wherein in a region (290*a*) connecting the storage chamber and the removal chamber, the bottom foil (220) and the covering foil (230) are connected by a seal in such a way that by exerting is pressure from the outside onto the storage chamber, the seal of the bottom and covering foil becomes detached in the connecting region and there is formed between the storage chamber and removal chamber a through-channel through which the substance can be transferred from the storage chamber wholly or partly to the removal chamber.

22. Packaging (200) according to claim 21, wherein the seal between the covering foil (230) and bottom foil (220) is weakened in the region (290*a*) connecting the storage chamber (290) and the removal chamber (240) in such a way that by exerting a pressure from the outside onto the storage chamber, the seal becomes detached in the connecting region and there is formed between the storage chamber and removal chamber a through-channel through which the substance can be transferred from the storage chamber wholly or partly to the removal chamber.

23. Packaging (200) according to claim 21, wherein the through-channel has a cross section widening toward the removal chamber (240).

24. Packaging (200) according to claim 21, wherein the removal chamber (240) is arranged in such a way that by detaching the first portion (231) of the covering foil, the removal chamber can be opened at least sufficiently wide to allow the substance to be transferred from the storage chamber (290) to the removal chamber (240) to be removed.

25. Packaging (200) according to claim 24, wherein:

a first portion (240*a*) of the removal chamber is covered by the first portion (231) of the covering foil and a second portion (240*b*) of the removal chamber is covered by the second portion (232) of the covering foil, so that on detachment of the first portion of the covering foil, only the first portion of the removal chamber is opened, wherein the second portion of the removal chamber is that portion of the removal chamber that adjoins the region (290*a*) connecting, the removal chamber (240) to the storage chamber (290).

26. Packaging according to claim 21, wherein a second storage chamber containing a second free-flowing, paste-like or powdery substance, wherein in a region connecting the second storage chamber and an adjacent chamber, the bottom foil and the covering foil are connected by a seal in such a way that by exerting a pressure from the outside onto the second storage chamber, the seal of the bottom and covering foil becomes detached in the connecting region and there is formed between the second storage chamber and the adjacent chamber a through-channel through which the substance can be transferred from the second storage chamber wholly or partly to the adjacent chamber, so that a mixture of the first and second substance can be prepared in the adjacent chamber.

27. Method for storing and applying a free-flowing, paste-like or powdery substance, comprising:

providing a packaging (100, 200) according to claim 1, opening the removal chamber (140, 240) by detaching the first portion (131, 231) of the covering foil (130, 230), wherein the plastic deformation, required for opening the removal chamber, of the covering foil occurs substantially in the second portion (112, 232) of the covering foil, exerting a pressure from the outside onto the storage chamber (290), so that in a region (290*a*) connecting a storage chamber and the removal chamber, the seal of the bottom and covering foil becomes detached and a through-channel is formed between the storage chamber and removal chamber, also transferring the substance from the storage chamber wholly or partly to the removal chamber, and applying the substance contained in the removal chamber or transferred to the removal chamber using an applicator.

28. The packaging of claim 1, wherein said second portion of said bottom foil is spaced from said first portion at a first end of said bottom foil and from a first end of said removal chamber.

29. The packaging of claim 1, wherein said first portion of said covering foil is separated from a top surface of said bottom foil to define an opening to said removal chamber between said first portion of said cover foil and said top surface of said bottom foil.

30. The packaging of claim 1, wherein said bottom foil includes an applicator chamber spaced from said removal chamber, and where said second portion of said bottom foil is positioned between said removal chamber and said applicator chamber and said second portion of said cover foil is sealed to said second portion of said bottom foil.

31. The packaging of claim 30, wherein said applicator chamber has a first end portion covered by said first portion of said cover foil and a second end portion covered by said second portion of said cover foil.

32. The packaging of claim 1, wherein said removal chamber is formed at a first end of said bottom foil, said first portion of said covering foil is formed at a first end of said covering foil, and said second portion of said covering foil is spaced from said first end toward a second end of said covering foil.

33. Packaging (100, 200) for storing a free-flowing, paste-like or powdery substance (110), comprising a bottom foil (120, 220) and a covering foil (130, 230) which are sealed to each other at least in certain portions, a removal chamber (140, 240) which is formed in a first portion proximate a front edge of the bottom foil and a first portion of a bottom surface of the covering foil that are detachably sealed to one another at least in certain portions, and an applicator chamber (160, 260) laterally spaced from said removal chamber, wherein a portion of said applicator chamber is laterally adjacent to and extends behind said removal chamber, wherein the first portion of the covering foil overlying and surrounding said removal chamber in said bottom foil and sealed to said bottom foil around said removal chamber, the removal chamber can be opened by detaching at least said first portion (131,231) of the covering foil from the bottom foil, the first portion of the covering foil having a first reinforcement layer formed of plastic material or paper and attached to a top surface of said first portion of said covering foil, wherein a second portion (132, 232) of the covering foil is arranged adjacent to and behind the first portion and overlying and sealed to a second portion of the bottom foil adjacent to and behind a back edge of said removal chamber, wherein the second portion displays less deformation resistance than the first portion of the covering foil and first reinforcement layer, so that separating the first portion of the covering foil and the first reinforcement layer from the bottom foil causes deformation in the second portion of the covering foil, said covering foil having a third portion with a bottom surface sealed to a third portion of the bottom foil, said third portion of the covering foil being adjacent to and behind said second portion to define the second portion between the first and third portions, wherein the third portion of the covering foil has a second reinforcement layer on a top surface of said third portion of said covering foil, wherein said first and second reinforcement layers are separated by the second portion of the covering foil, wherein the deformation occurring in the second portion (132, 232) of the covering foil (130, 230) during opening of the removal chamber (140, 240) displays a higher proportion of plastic deformation than deformation occurring in the first portion (131, 231) of the covering foil during opening of the removal chamber.

34. Collecting container for storing at least one free-flowing, paste-like or powdery substance, wherein by a plurality of packages (100, 200) according to claim 33, which are separably connected to one another.

35. The packaging of claim 33, wherein said bottom foil has a first portion and a second portion, said removal chamber being formed in said first portion, and said second deformable portion of said cover foil is sealed to said second portion of said bottom foil.

36. A package for storing a material comprising:

a bottom foil having a first portion at a first end of the bottom foil with a removal chamber formed therein for receiving the material, said removal chamber formed proximate a front edge of the bottom foil, an applicator chamber (160, 260) laterally spaced from said removal chamber, wherein said applicator chamber is laterally adjacent to extends behind, said removal chamber, a second portion adjacent to and behind said first portion, and a third portion adjacent to and behind said second portion;

a cover foil sealed to said bottom foil for closing said removal chamber, said cover foil having a bottom surface with a first portion, a second portion and a third portion, said first portion overlying and sealed to said first portion of said bottom foil and said removal chamber, said first portion having a first reinforcement layer formed of plastic material or paper on a top surface to resist deformation of said first portion;

said second portion of said cover foil being adjacent to and behind said first portion and first reinforcement layer and sealed to said second portion of the bottom foil behind a back edge of said removal chamber, and said third portion sealed to said third portion of the bottom foil and being adjacent to and behind said second portion of said cover foil, and a second reinforcement layer on a top surface of said third portion of said cover foil to define said second portion between said first portion and said third portion of said cover foil, said second reinforcement layer being separate from said first reinforcement layer, said second portion of said cover foil being more deformable relative to said first portion of the cover foil upon opening said cover foil.

37. The packaging of claim 36, wherein said first portion of said cover foil is sealed to said bottom foil by a seal surrounding said removal chamber.

38. The packaging of claim 37, wherein said bottom foil further comprises a storage chamber and where said first portion of said cover foil overlies a portion of said storage chamber whereby peeling said first portion of said cover foil from said bottom foil completely opens said removal chamber and partially opens said storage chamber.

39. The packaging of claim 36, wherein said cover foil has a longitudinal dimension corresponding to a peeling direction of said cover foil, said cover foil having a first longitudinal end, a second longitudinal end, a first side edge and a second side edge, and where said second portion of said cover foil defines a deformable portion extending between said first and second side edges substantially transversely to said package.

40. Packaging (100, 200) for storing a free-flowing, paste-like or powdery substance (110), comprising a bottom foil (120, 220) and a covering foil (130, 230) having a bottom surface with a first portion and a second portion which are sealed to each other at least in certain portions, a removal chamber (140, 240) which is formed in a first portion proximate a front edge of the bottom foil and said first portion of the covering foil that are detachably sealed to one another at least in certain portions, and an applicator chamber (160, 260) laterally spaced from said removal chamber, wherein a portion of said applicator chamber is laterally adjacent to and overlaps with, but extends longitudinally behind said removal chamber, wherein the removal chamber can be opened by detaching at least said first portion (131, 231) of the covering foil from the bottom foil, said second portion (132, 232) of the covering foil, which is arranged adjacent to and behind the first portion of the covering foil displays less deformation resistance than the first portion of the covering foil, so that deformation, required for permanently opening the removal chamber of the covering foil occurs substantially in the second portion of the covering foil, wherein said second portion of the covering foil is sealed to a second portion of the bottom foil behind a back portion of said removal chamber, wherein the deformation resistance of the second portion is lower than the deformation resistance of the first portion and is realized by strengthening in the region of the first portion of the covering foil by a reinforcement layer formed of plastics material or paper on a top surface of the first portion of the covering foil, wherein the reinforcement layer completely covers said removal chamber when said covering foil is sealed to said bottom foil, wherein the deformation occurring in the second portion (132, 232) of the covering foil (130, 230) during opening of the removal chamber (140, 240) is substantially plastic deformation; and the deformation occurring in the second portion (132, 232) of the covering foil (130, 230) during opening of the removal chamber (140, 240) displays a higher proportion of plastic deformation than the deformation occurring in the first portion (131, 231) of the covering foil during opening of the removal chamber.

* * * * *